US008177393B2

(12) United States Patent
Altamura et al.

(10) Patent No.: US 8,177,393 B2
(45) **Date of Patent: *May 15, 2012**

(54) MECHANICAL BYPASS LIGHT UNIT

(75) Inventors: Steven J. Altamura, Scarsdale, NY (US); Robert C. Neuman, Cannon Falls, MN (US); Dennis Wang, Hon Kong (CN)

(73) Assignee: Seasonal Specialties, LLC, Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/908,207

(22) Filed: Oct. 20, 2010

(65) Prior Publication Data

US 2011/0038158 A1 Feb. 17, 2011

Related U.S. Application Data

(63) Continuation of application No. 11/978,150, filed on Oct. 25, 2007, now Pat. No. 7,819,552.

(60) Provisional application No. 60/854,174, filed on Oct. 25, 2006.

(51) Int. Cl.
*F21S 4/00* (2006.01)

(52) U.S. Cl. ..... 362/249.12; 362/654; 362/655; 362/802; 200/51.1; 313/318.01; 313/318.1; 439/188

(58) Field of Classification Search ..... 362/249.05, 362/249.12, 653–655, 802; 313/318.01, 313/318.1; 200/51.1; 439/188
See application file for complete search history.

(56) References Cited

U.S. PATENT DOCUMENTS

| | | | | |
|---|---|---|---|---|
| 1,536,332 | A | 5/1925 | Dam | |
| 5,453,664 | A | 9/1995 | Harris | |
| 6,257,740 | B1 | 7/2001 | Gibboney, Jr. | |
| 6,609,814 | B2 | 8/2003 | Ahroni | |
| 6,755,552 | B2 | 6/2004 | Lee | |
| 6,805,463 | B2 | 10/2004 | Shieh | |
| 7,264,392 | B2 * | 9/2007 | Massabki et al. | 439/188 |
| 7,819,552 | B2 * | 10/2010 | Altamura et al. | 362/249.12 |
| 2006/0146578 | A1 * | 7/2006 | Kuo | 362/654 |

* cited by examiner

*Primary Examiner* — Stephen F Husar
(74) *Attorney, Agent, or Firm* — Altera Law Group, LLC

(57) ABSTRACT

A light unit includes a bulb having a light source with lead wires and a separator, a switch member that includes a support member and a pair of spring terminals, and a socket having two or more conductive terminals and adapted to receive the bulb and the switch member. The switch member is adapted to cause the pair of spring terminals to contact one another to form an electrical short circuit across the pair of conductive terminals and the light source when the bulb is completely or partially removed from the socket. The lead wires form an electrical connection across the conductive terminals and the separator breaks contact between the pair of spring terminals when the bulb is seated in the socket.

12 Claims, 23 Drawing Sheets

MECHANICAL BYPASS LIGHT UNIT

This application is a continuation of application Ser. No. 11/978,150, filed 25 Oct. 2007 which issued on 26 Oct. 2010, as Pat. No. 7,819,552. The application is incorporated herein by reference.

RELATED APPLICATION

The present application claims priority to U.S. Provisional Application No. 60/854,174, filed Oct. 25, 2006, and entitled MECHANICAL BYPASS LAMPHOLDER, which is incorporated by reference herein in its entirety.

FIELD OF THE INVENTION

The present invention is generally related to an improved light unit for a light string utilizing incandescent, LED, or other types of bulbs, and more particularly, the present invention relates to a light bulb base used in conjunction with a socket and switch that will continue to reliably and safely conduct electricity and keep the remainder of the string of lights lit even when one or more individual light bulbs are missing from, or becomes loose in, the socket.

BACKGROUND OF THE INVENTION

Light strings having lights connected electrically in series are well known, especially around the holidays when such light strings are used for decorative purposes. Generally, the lights in the string are electrically in series, rather than in parallel. One particular drawback to these types of light strings is that when a light bulb is removed from the socket, the entire series is rendered inoperable. Each light bulb within its respective socket completes the electrical circuit, so when a light bulb is removed or becomes loose, a gap is created in the circuit and electricity is unable to continue to flow through the circuit. When a light bulb is inserted back into the socket or the loose bulb reseated, it completes the circuit, thus allowing electricity to flow uninterrupted.

A number of known light units and light strings attempt to address this issue of rendering a light set inoperable due to a missing or loose bulb. For example, U.S. Pat. No. 6,257,740 issued to Gibboney, Jr., discloses a basic light unit that allows current to flow in the absence of a bulb. More specifically, Gibboney, Jr. discloses a switch mechanism that comprises a pair of relatively long, centrally-located spring terminals in a light unit. Each spring terminal is connected to a wire terminal at an interior wall of the light unit and extends inwards to the center of the light unit. When a bulb is absent from the light unit, the two spring terminals are in contact with one another, allowing current to flow through the light unit and to other light units in a light set. When a specially-adapted bulb is inserted into the light unit, the bulb separates the two spring terminals, breaking the electrical contact point, routing current to the bulb filament. As such, Gibboney, Jr. teaches that when a bulb is removed, the contacts spring inward towards the center of the light unit, to where the bulb was previously located.

In another example, U.S. Pat. No. 6,609,814 issued to Ahroni, discloses a light unit with a centrally-located mechanical switch and shunt element adapted for use with a non-conventional flat-wire light set. However, most decorative light strings utilize a twisted-pair wiring convention for which the Ahroni design cannot easily be adapted.

One of the drawbacks to the light units discussed above and of other similar mechanical designs, is a lack of reliability.

For example, over time, memory effects present in the spring terminals may cause switch failure. For designs such as those described above, the spring terminals may be relatively long, with long moment arms and with the spring terminals often being integral to the wire terminals. Because bulbs are removed infrequently from any individual light unit, the spring terminals tend to be in a compressed state for long periods of time. When a bulb is ultimately removed, or becomes loose, the spring terminals move towards their original position of contact, but the spring terminals may not move all the way back to the original contact position due to the extended period of time spent in the compressed, or tensioned, position.

In addition to memory effects, further unreliability comes from movement of the switch elements within the socket. When bulbs are inserted or removed, switch contacts and supports may be dislodged or otherwise moved from their original operational positions, causing the switch to fail.

Another drawback of such designs is the relatively large area of electricity conducting material exposed when a bulb is removed. When a bulb is removed, electricity flows through the centrally-located spring terminals which span the inside diameter of the light unit. If a foreign object is inserted into the light unit when the bulb is removed, but the light set powered, the risk of electric shock is great.

In addition to known mechanical solutions to the problem of missing or loose bulbs, electrical solutions also exist. For example, some light sets use a pair of back-to-back zener diodes located in a light unit and electrically in parallel with the bulb. When a bulb is dislodged from its socket, the voltage potential across the diodes is larger than the threshold voltage of the diodes, causing the diodes to conduct.

The primary drawback to light units utilizing such electrical solutions is the high cost of the electrical components. Other drawbacks include heating of the electrical elements in the socket, complexity of design, custom manufacturing requirements and rigid tolerances.

Therefore, what is needed in the industry is an improved light unit that not only allows current to flow through the light unit when a bulb is loose or removed, but also addresses the reliability, safety and cost issues as described above.

SUMMARY OF THE INVENTION

The systems and methods of the present invention have several features, no single one of which is solely responsible for its desirable attributes. Without limiting the scope of the invention as expressed by the claims which follow, its more prominent features will now be discussed briefly.

In one embodiment, the present invention is a light unit for use in a light string. The light unit includes a bulb having a light source with lead wires and a separator, a switch member that includes a support member and a pair of spring terminals, and a socket having two or more conductive terminals and adapted to receive the bulb and the switch member. The switch member is adapted to cause the pair of spring terminals to contact one another to form an electrical short circuit across the pair of conductive terminals and the light source when the bulb is completely or partially removed from the socket. The lead wires form an electrical connection across the conductive terminals and the separator breaks contact between the pair of spring terminals when the bulb is seated in the socket.

In another embodiment, the present invention is a light unit for use in a light string, and includes a bulb having a light source with a first lead wire and a second lead wire, and a separator. The light unit also includes a switch member that has a support member that includes a conductive contact with a first and a second free end, and a socket having a first and a second conductive terminal. The socket is adapted to receive the bulb and the switch member. The switch member is adapted to cause the first free end to contact the first free conductive terminal and the second free end to contact the second conductive terminal, and form an electrical short circuit across the first and second conductive terminals and the light source when the bulb is completely or partially removed from the socket. When the bulb is seated in the socket, the first lead wire contacts the first conductive terminal, the second lead wire contacts the second conductive terminal and the separator causes at least one of the free ends of the contact to move in a direction away from one of the conductive terminals.

In yet another embodiment, the present invention is a light unit for use in a light string, the light unit including a bulb having a light source and lead wires, a rotating switch member with a support member and at least one conductor affixed to the support member, and a socket having two or more conducting terminals and adapted to receive the bulb and the switch member. The rotating switch member is adapted to rotate when the bulb is completely or partially removed from the socket, thereby causing the at least one conductor to form an electrical short circuit across the pair of conductive terminals.

As will be realized, the invention is capable of other, different embodiments and its details are capable of modifications in various respects, all without departing from the invention. Accordingly, the drawing and description are to be regarded as illustrative and not restrictive.

Other advantages and novel features of the present invention will be drawn from the following detailed description of embodiment of the present invention with the attached drawings. The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF THE DRAWINGS

Figure 1:
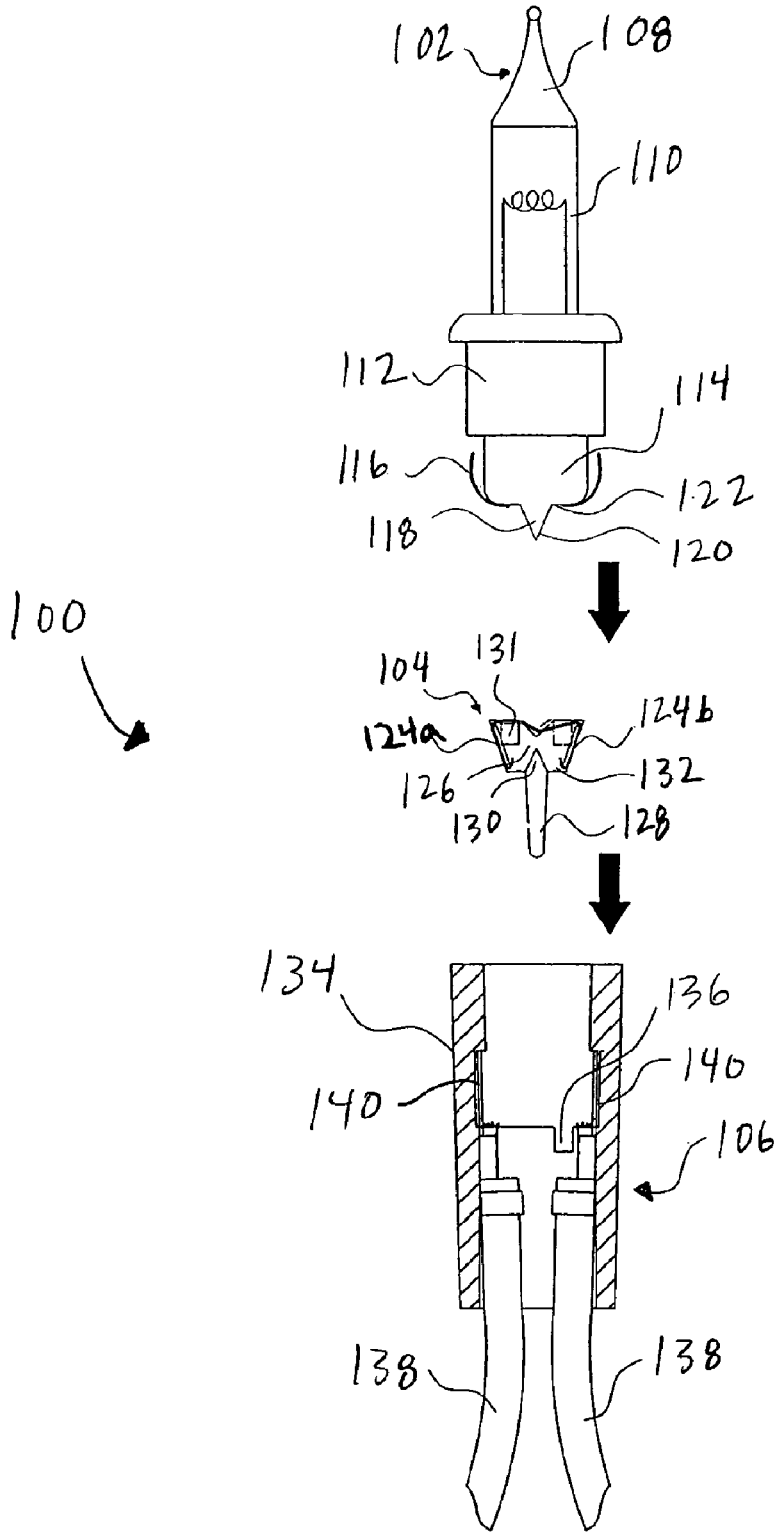
FIG. 1 is an exploded, partial sectional view of a light unit for use in string lights according to one embodiment of the present invention.

Throughout the drawings, the same reference numerals and characters, unless otherwise stated, are used to denote like features, elements, components or portions of the illustrated embodiments. Moreover, while the subject invention will now be described in detail with reference to the drawings, it is done so in connection with the illustrative embodiments. It is intended that changes and modifications can be made to the described embodiments without departing from the true scope and spirit of the subject invention as defined by the appended claims.

Referring to FIG. 1, an exploded, partially cut away, perspective view of one embodiment of light unit 100 for a light string is depicted. Light unit 100 for a light string comprises a light bulb 102, a switch member 104 and a light bulb socket 106.

Light bulb 102 includes globe 108, filament 110, base 112, subsidiary base 114, and lead wires 116. Subsidiary base 114 includes first separator 118 with centrally-located tip 120, and bottom 122. Base 112 and subsidiary base 114 can be removably received in light bulb socket 106.

Switch member 104 includes a pair of spring terminals 124, support member 126, and optional second separator 128. Second separator 128 is connected to support member 126 at joint 130, and is combined with spring terminals 124 which abut each other together at the top of switch member 104. In one embodiment, support member 126 includes a pair of mounting blocks 131, one located on each side of support member 126. Support member 126 may also include a pair of buckling slots 132.

Light bulb socket 106 includes a housing 134 with a pair of mounting grooves 136, and two or more terminal wires 138. An optional wire terminal 140 may be connected to each end of terminal wire 138 located within housing 134. Terminal wires 138 extend from outside housing 134 to the inside of housing 134, and are adapted to be connected to an electrical power source. As such, electrical current is introduced into the socket 106 by terminal wires 138 and conducted through the optional wire terminals 140, then either through spring terminals 124 if they are touching, or through lead wires 116 to filament 110. Regardless of the path, the current will flow and the circuit remains closed.

As described above, light bulb 102 has a globe 108 connected to a base 112. Globe 108 may be made of any conventional transparent or translucent material such as plastic or glass. Within globe 108 is a filament 110, or another similar light emitting device such as a light-emitting diode (LED), that extends down through base 112 and exits through subsidiary base 114. The ends of filament 110 that exit to the exterior of subsidiary base 114 are lead wires 116 which protrude out through bottom 122 of subsidiary base 114. In one embodiment, lead wires 116 wrap around subsidiary base 114 and extend upwardly in the direction of globe 108, adjacent base 112. The diameter of subsidiary base 114 is less than that of base 112, thereby preventing lead wires 116 from adhering to subsidiary base 114 or from being squeezed, or broken off, in the process of assembling base 112 into socket 106.

On the exterior of subsidiary base 114, located in the central region and between where lead wires 116 exit the lower portion of subsidiary base 114, first separator 118 protrudes in a downwardly direction away from bulb 102. First separator 118 may have a pointed, wedge shaped, or rounded tip 120 that facilitates separation of spring terminals 124 when they are together. Separator 118 serves to sever the physical and electrical connection between spring terminals 124, thereby eliminating any alternative, electrically conductive path for the electrical current to flow, other than through lead wires 116 and into filament 110, and thereby illuminating light bulb 102.

Referring to FIGS. 1 to 6, support member 126 is joined to second separator 128 at joint portion 130. Support member 126 is cubiform and hollow, and defines a cavity to completely receive the rounded tip 120 of the first separator 118. The size of the upper portion of the support member 126 may be different from the lower portion as depicted. Joint portion 130 extends from the support member 126 in the central region of the cavity. When light bulb 102 is received in the socket 106, a distal terminal of the first separator 118, tip 120, touches joint portion 130 or is supported upon support member 126 to prevent water accumulating at the distal end of the first separator 118. The optional second separator 128 serves to root adjacent terminal wires 138 in socket 106 and prevent shake of the wires 138. This helps to maintain a consistent electrical connection and to seal housing 134 of socket 106 in order to keep moisture outside from filtering into housing 134 along terminal wires 138. A pair of buckling slots 132 are symmetrically defined in the lower portion of cubiform support member 126 of switch member 104. The pair of mounting blocks 131 are symmetrically formed on the opposite sides of support member 126. The use of mounting blocks 131 to anchor switch member 104 greatly improves the overall reliability of light unit 100.

Figure 5:
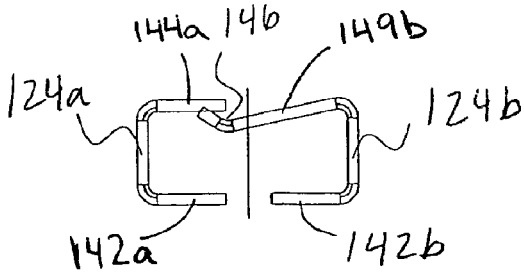
FIG. 5 is a front view of a pair of spring terminals of one embodiment of the present invention.

Referring to FIG. 5, the pair of spring terminals 124 includes a spring terminal 124*a* and a spring terminal 124*b*. Spring terminal 124*a* includes a bottom portion 142*a* and a top portion 144*a*. Similarly, spring terminal 124*b* includes a bottom portion 142*b* and a top portion 144*b*. In the embodiment depicted in FIG. 5, top portion 144*b* of spring terminal 124*b* is longer than top and bottom portions 142*a* and 144*a* of spring terminal 124*a* and of bottom portion 142*b* of terminal 124*b*. One end of top portion 144*b* is optionally bent upwards to form an upwardly inclined tip portion 146.

Figure 2:
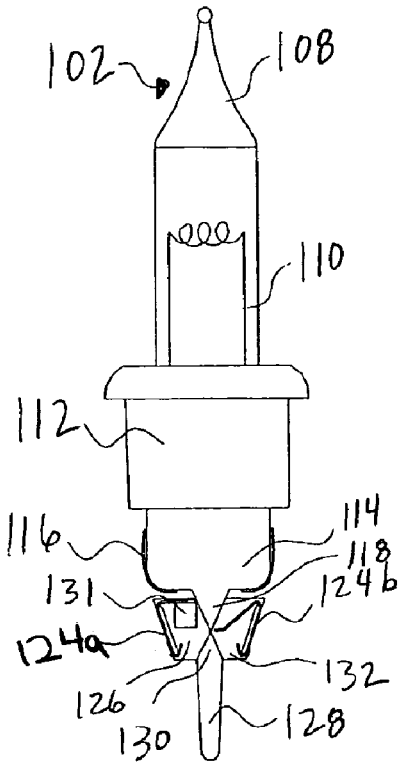
FIG. 2 is a front view of one embodiment of a bulb and switch member of the light unit.
Figure 3:
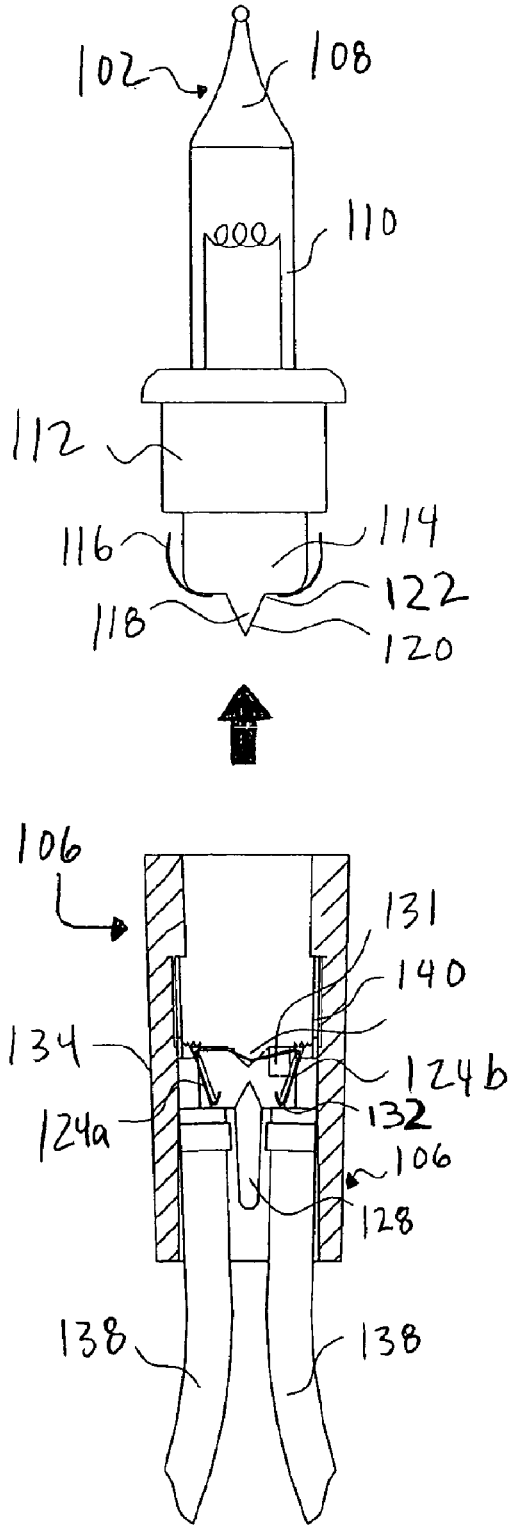
FIG. 3 is a an exploded, partial sectional view of one embodiment of the light unit of the present invention.
Figure 6:
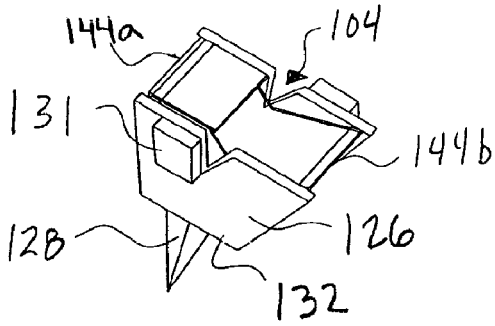
FIG. 6 is a front perspective view of one embodiment of a switch member of a light unit of the present invention.

Referring to FIGS. 2, 3 and 6, bottom portions 142 of spring terminals 124 are respectively buckled into their corresponding buckling slots 132, then each spring terminal 124 is bent to keep it in close contact with support member 126. The top portions 144 of twisted spring terminals 124 meet together at the top of support member 126. Upwardly inclined tip portion 146 serves to complete the circuit and to simultaneously locate first separator 118. Buckling spring terminals 124 into their respective buckling slots further increases the reliability of light unit 100 by limiting the opportunity for spring terminals to become dislodged through repeated use, mishandling, or incidental contact with a foreign body.

The pair of buckling slots 132 function as spring terminal fixing elements, and alternatively as water canals for accumulated moisture inside socket 106 in dank weather. In an alternative embodiment of the present invention, buckling slots 132 function as a water canal for accumulated dewdrops in socket 106 in dank weather and may also include a pair of independent through holes. Such improved water shedding capabilities improve the safety of light unit 100 by reducing the likelihood that water within the light unit will conduct electricity, thereby causing electric shock.

Referring to FIG. 3, when light base 112 is not located in socket 106, spring terminals 124, which are biased toward one another with sufficient force so that they meet each other, form a connection through which electrical current can flow.

For mounting purposes, support member 126 substantially forms a trapezoid in one embodiment. A pair of mounting grooves 136 are defined inside housing 134 of socket 106. The symmetrical mounting blocks 131 are respectively received in corresponding mounting grooves 136 so as to securely mount the support member 126. Housing 134 forms a shoulder, when spring terminals 124 together with switch member 104 are mounted in socket 106, each of the terminals 124 touching an electric terminal 140. Electric terminals 140 are connected with terminal wires 138, and terminal wires 138 are connected with an outside power source. The electric terminals 140 should be long enough to tightly connect both the spring terminals 124 and the lead wires 116 of filament 110.

As embodied and broadly described herein, FIG. 3 illustrates light bulb 102 being removed from socket 106. As base 112 is moved out of socket 106, electrical current flows through spring terminals 124 and the upwardly inclined tip portion 146. Spring terminals 124 are biased toward one another with sufficient force so that they meet each other to form a reliable connection through which electrical current can flow. The spring terminals 124 are electrically connected with terminal wires 138 through electric terminals 140. Each terminal wire 138 extends through the bottom of the socket 106 and is ultimately connected to an electrical source. Therefore, electrical current is introduced into the socket 106 by terminal wires 138 and conducted through spring terminals 124 when they are touching, to complete the circuit and keep the remaining series-connected light units 100 illuminated without interruption.

Figure 4:
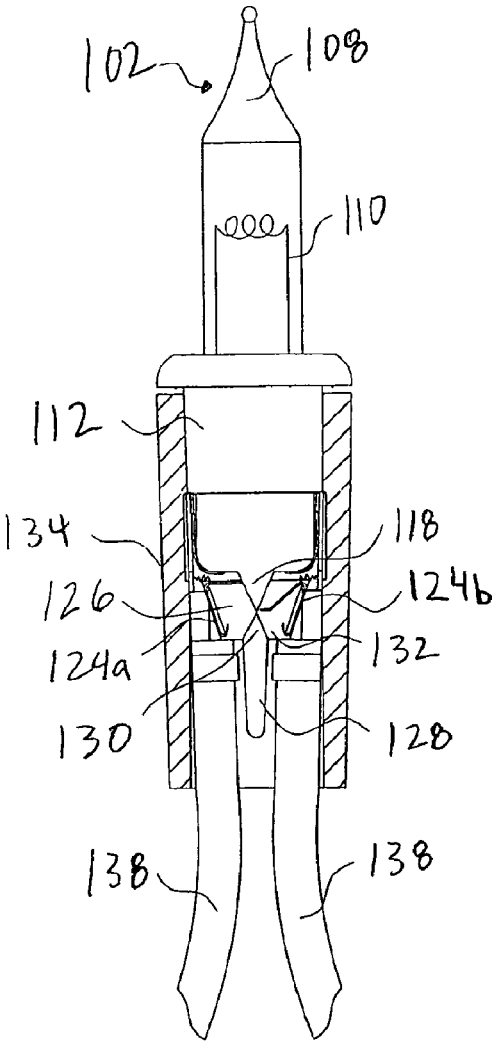
FIG. 4 is a partial sectional view of one embodiment of an assembled light unit of the present invention.

FIG. 4 illustrates light bulb 102 inserted into, and fully seated in, socket 106. As base 112 is inserted into socket 106, electrical current flowing through spring terminals 124 is interrupted when physical contact between spring terminals 124 is broken by first separator 118 and is allowed to flow through lead wires 116 and up through the filament 110, hence illuminating bulb 102. The current then resumes flowing out through the opposite side of the filament 110 from which it entered and down through the other lead wire 116, passing through the other terminal wire 138, until it exits that particular light unit 100.

Spring terminals 124 are preferably made of a resilient, conductive metal such as brass, steel, or copper.

Figure 7:
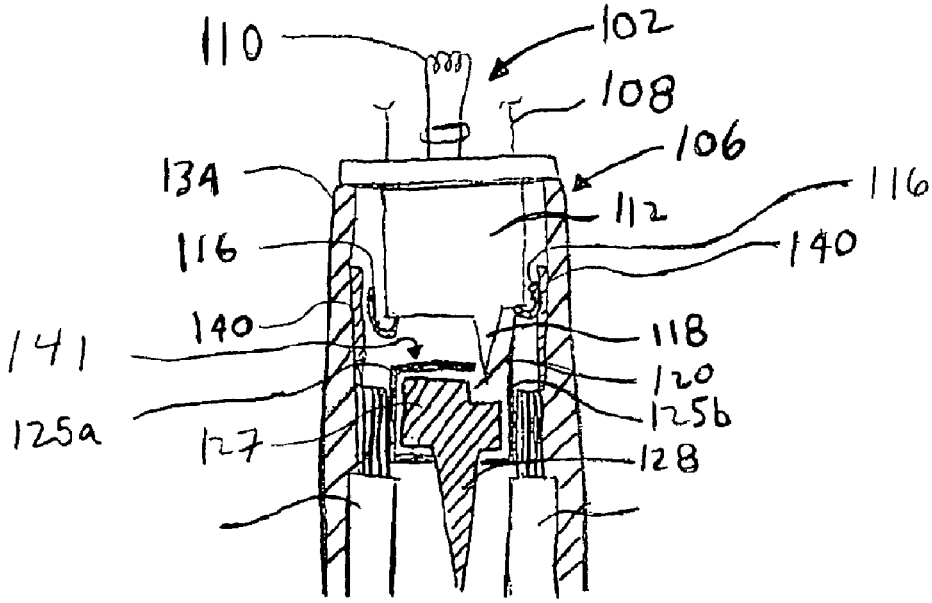
FIG. 7 is a front sectional view of one embodiment of the light unit of the present invention that includes an off-center pair of spring terminals.

Referring now to FIG. 7, in another embodiment of light unit 100, separator 118 is not centrally located on base 113, and the switch member is adapted accordingly. Further, in some embodiments, base 113 may include an integrated subsidiary base, as is depicted in FIGS. 7 and 10. Other embodiments similar to those previously described may include a base and a separate subsidiary base combination, wherein separator 118 is located non-centrally on the subsidiary base. In most other respects, and unless otherwise noted, the embodiments depicted in FIGS. 7-12 are substantially similar to those depicted and described above, and may incorporate the reliability and safety features as also depicted and described.

As depicted in FIG. 7, in this embodiment, light unit 100 includes a bulb 102, switch member 141, and socket 120. FIG. 7 depicts switch member 141 located in socket 106, with bulb 102 completely seated into socket 106. As depicted, switch member 141 would be in the open position as described further below.

Bulb 102 includes globe 108, filament 110, lead wires 116, and base 113. Base 113 includes first separator 118 with tip 120, and base bottom 122. Bulb 102 resembles and functions similarly to the previously described embodiment, except that bulb 102 in this embodiment includes base 113 rather than the combination of base 112 and subsidiary base 114. First separator 118 is not centrally located in base 209, whereas separator 118 is centrally located in subsidiary base 114. In this embodiment, separator 118 is located off-center, and near one side of base 113. Base 113 may be keyed such that bulb 102 may only be inserted as depicted in FIG. 7.

Figure 8:
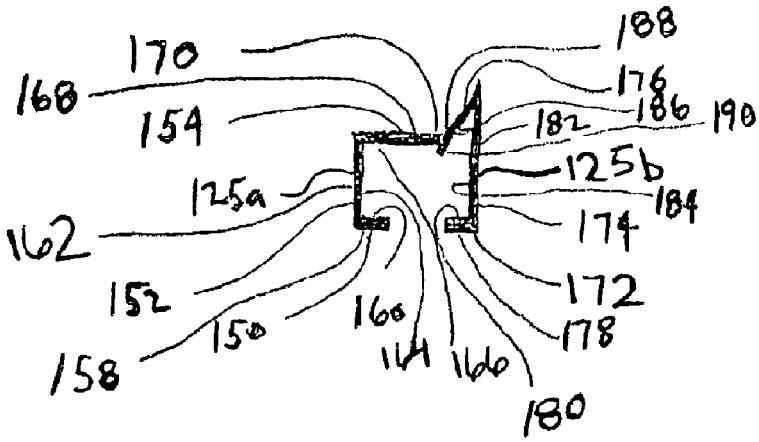
FIG. 8 is a front view of a pair of terminals of one embodiment of a light unit of the present invention.
Figure 9:
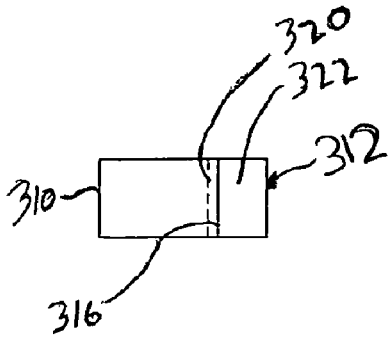
FIG. 9 is a top view of a pair of terminals of one embodiment of a light unit of the present invention.
Figure 10:
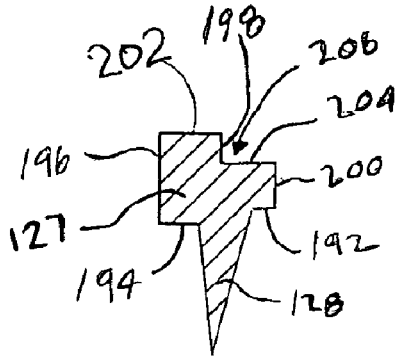
FIG. 10 is a front view of a support member of a switch member of one embodiment of a light unit of the present invention.

Referring now to FIGS. 8 and 9, switch member 141 includes a pair of spring terminals 125. In this embodiment, spring terminal 125*a* includes three portions, bottom portion 150, middle portion 152, and top portion 154. Bottom portion 150 includes a lower surface 158 and an upper surface 160. Middle portion 152 includes outside surface 162 and an inside surface 164. Top portion 154 includes bottom surface 166, top surface 168 and tip region 170. Bottom portion 150 generally forms a right angle with middle portion 152, middle portion 152 generally forms a right angle with top portion 154, while bottom portion 150 is generally parallel with top portion 154. In the embodiment depicted, top portion 154 is longer than bottom portion 150. In other embodiments, spring terminal 125*a* may not be constructed with right angles, and may have a more curvilinear shape.

Spring terminal 125*b* also includes three portions, bottom portion 172, middle portion 174 and top portion 176. Bottom portion 172 includes lower surface 178 and upper surface 180. Middle portion 174 includes outside surface 182 and inside surface 184. Top portion 176 includes bottom surface 186, top surface 188 and tip region 190. Bottom portion 172 generally forms a right angle with middle portion 174, and middle portion 174 generally forms an acute angle with top portion 176.

Figure 11:
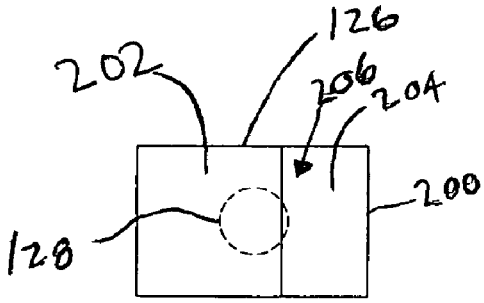
FIG. 11 is a top view of a support member of a switch member of one embodiment of a light unit of the present invention.
Figure 12:
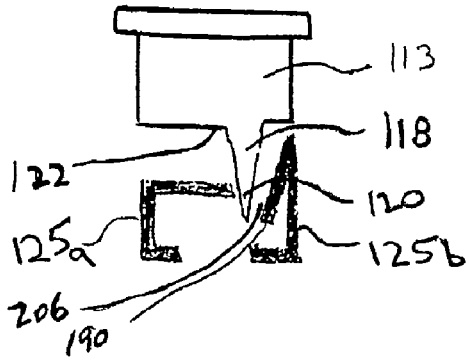
FIG. 12 is a front view of a base and pair of terminals of one embodiment of light unit of the present invention.

Referring now to FIGS. 10 and 11, switch member 131 also includes support member 127. Support member 127 optionally includes second separator 128, bottom surfaces 192 and 194, side surfaces 196, 198 and 200, top surfaces 202 and 204, and swing region 206. Support member 127 may be substantially similar to previously described support member 126 by being essentially hollow, or alternatively, may be a solid structure as depicted.

Referring again to FIG. 7, when assembled, spring terminals 125 are located adjacent support member 127 to form switch member 141, which is in turn located in socket 106. More specifically, spring terminal 125*a* is located onto support member 127 such that terminal surfaces 160, 164, and 166 are located adjacent support member surfaces 194, 196, and 202, respectively. Portions of spring terminal 125*b* are likewise located adjacent support member 127. Terminal surface 180 is located adjacent support member surface 192, while a portion of terminal surface 184 is adjacent support member surface 200. In some embodiments, spring terminals 125 may be affixed to support member 127, while in some embodiments, spring terminals 125 may be held in relation to support terminal 127 with assistance from socket 106.

Referring to FIG. 8, when bulb 102 is completely removed from socket 106, or in some cases partially removed, first separator 118 does not contact spring terminals 125. In this case, spring terminals 125 located within socket 106 will be positioned relative to one another as depicted in FIG. 8. More specifically, tip region 170 of spring terminal 125*a* will be in physical and electrical contact with tip region 190 of spring terminal 125*b*. In this position, switch member 141 is closed, and when electrical power present, current flows directly between terminals 125*a* and 125*b*, bypassing filament 110.

Referring now to FIGS. 7-9 and 12, when bulb 102 is inserted into socket 106, tip 120 of first separator 118 contacts top surface 188 of top portion 176 of spring terminal 125*b*. As downward force is applied to top portion 176, it moves generally downward and towards middle portion 174, passing through swing region 206 such that terminals 125*a* and 125*b* are no longer in contact. When fully seated, bottom 122 of base 113 is adjacent top surface 168 of spring terminal 125*a*. In some embodiments, all, or a portion of, bottom 122 may directly contact terminal 125*a*. Tip region 190 and/or separator tip 120 may contact surface 204 of support member 127. As such, support member 127 and its surface 204 serve to restrict top portion 176 from moving too far towards middle portion 174, thereby preventing top portion 176 from breaking off of terminal 125*b* after repeated use. Member 127 and surface 204 may also thereby serve to locate base 113, separator 118, and tip 120 in socket 106. Further, when bulb 102 is fully inserted into socket 106, lead wires 116 make contact with terminals 140, causing current to flow through filament 110 when the light unit is powered.

Conversely, when bulb 102 is removed from socket 106, top portion 176 springs upwards such that terminals 125*a* and 125*b* are in contact at tip regions 170 and 190, respectively, allowing current to flow directly between the terminals.

Figure 14:
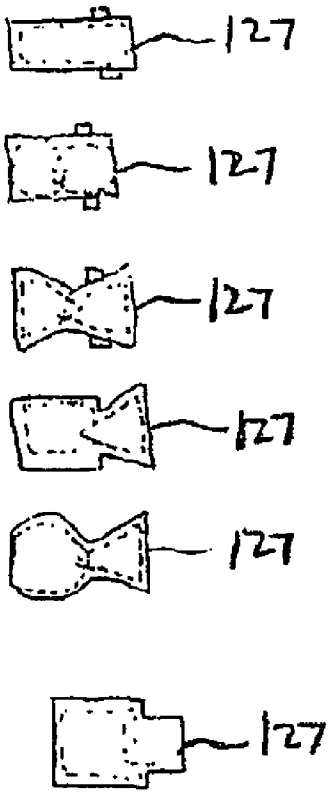
FIG. 14 is a series of top views of support members corresponding to the spring terminals of FIG. 13 of one embodiment of a light unit of the present invention.
Figure 13:
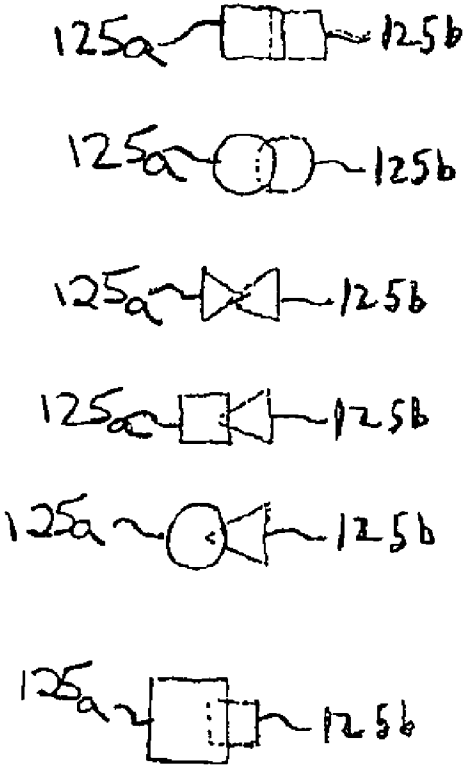
FIG. 13 is a series of top views of various embodiments of spring terminals of light units of the present invention.

Referring now to FIGS. 13 and 14, spring terminals 125 and support members 127 may take a variety of shapes, including rectangular, square, triangular, circular, or some combination thereof. The shape and size of terminals 125, and corresponding shape and size of support member 127 may be varied as shown to accommodate particular bulb 102 and socket 106 shapes and designs. Further, the shape chosen for terminals 125 may be varied according environmental conditions such as extreme wetness or vibration. In one embodiment, 125*a* and 125*b* are triangularly shaped to allow a maximum volume of water to flow through socket 106 unobstructed.

Figure 15:
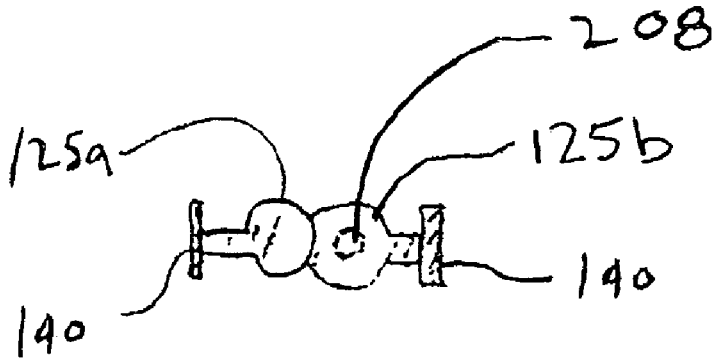
FIG. 15 is a top view of a pair of spring terminals connected to a pair of wire terminals of one embodiment of a light unit of the present invention.
Figure 16:
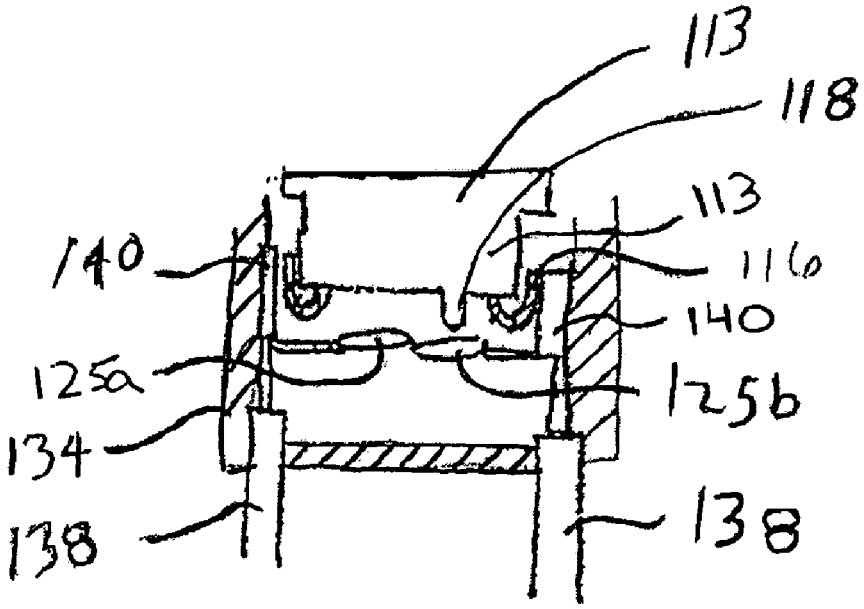
FIG. 16 is a front, partial cross-sectional view of one embodiment of a light unit of the present invention that includes spring terminals directly connected to wire terminals.

Referring to FIGS. 15 and 16, in yet another embodiment of light unit 100, support member 126 or 127 has been eliminated. In the depicted embodiment, terminals 125 are affixed to wire terminals 140, and project towards the center of socket housing 134, and generally perpendicular to wire terminals 140. Spring terminal 125*b* may include a locating hole or dimple 208 for locating first separator 118 when it contacts terminal 125*b*. As described above, terminals 125 are comprised of a conducting material, and are constructed such that at least spring terminal 125*b* moves in a downward direction when first separator 118 applies a downward force on the terminal. Terminal 125*a* may be constructed to flex upon contact with base 113, or may be constructed to be more rigid, or fixed, acting as a limit or stop to the motion of base 113. As in other embodiments, when bulb 102 with base 113 are inserted into socket 106, first separator 118 separates terminals 125 by moving at least terminal 125*b* downwards and away from terminal 125*a*. Lead wires 116 contact wire terminals 140. Insertion of bulb 102 into socket 106 breaks the contact between terminals 125, and allows power to flow through wire terminals 140 and filament 110, when power is applied to light unit 100.

Figure 17:
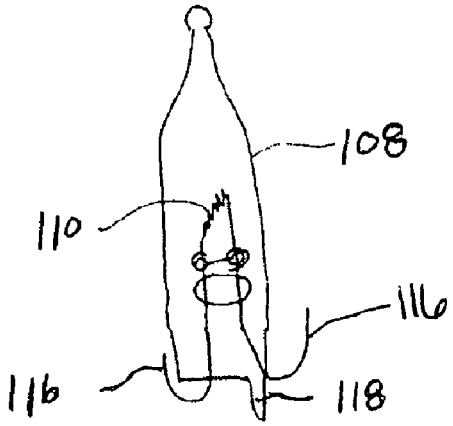
FIG. 17 is a front view of a bulb globe with an integral separator of one embodiment of a light unit of the present invention.
Figure 18:
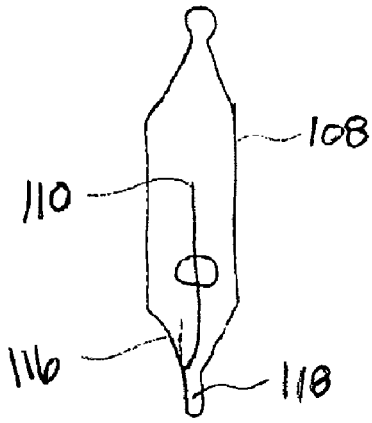
FIG. 18 is a side view of a bulb globe with an integral separator of one embodiment of a light unit of the present invention.

Referring now to FIGS. 17-18, in alternate embodiments of light unit 100, first separator 118 is integral to globe 108, rather than base 113 or 114. FIG. 17 depicts an incandescent bulb 102 without its base or subsidiary base. Bulb 102 includes a globe 108, filament 110, lead wires 116 and first separator 118. In this embodiment, first separator 118 is integrated into globe 108, and both are typically made of glass. Although glass separator 118 performs the same operation as separators 118 that are integrated into base 113 or 114, glass separator 118 provides a rigidity and hardness not typically available with the plastic materials typically used to mold bases 113 and 114. The extra stiffness provided by the glass material ensures that separator 118 will not flex when forced against terminals 124 or 125, ensuring proper operation of switch member 141. Further, a glass separator 118 maintains its stiffness and rigidity after repeated use, unlike plastic materials.

As depicted in FIGS. 17 and 18, the separator may be located off-center to work with light units 100 as previously described in conjunction with FIGS. 7-16. In other embodiments, separator 118 may be located in the central, lower portion of globe 108 in order to work with embodiments capable of using a centrally-located separator, such as the embodiments previously described in conjunction with FIGS. 1-6.

When an off-center separator 118 is integrated into globe 108, the adjacent lead wire may be routed to exit globe 108 at, or near, separator 118. Doing so aids in ensuring that lead wire 116 near separator 118 will contact its respective wire terminal 140.

Figure 19:
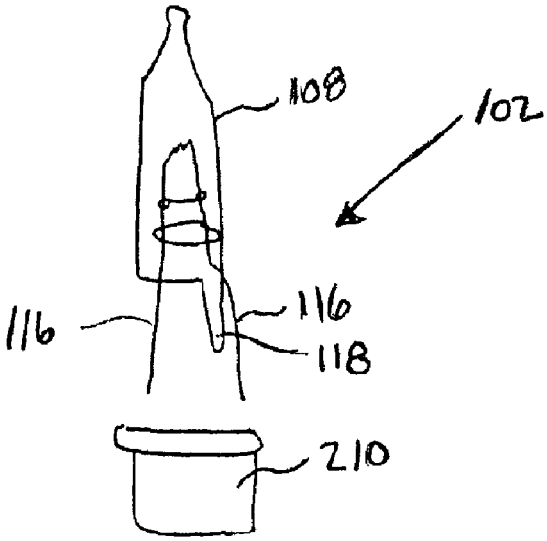
FIG. 19 is a partially exploded, front view of a bulb globe with an integral separator and its corresponding base of one embodiment of a light unit of the present invention.
Figure 20:
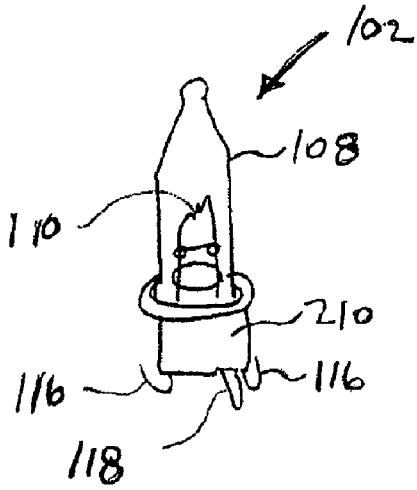
FIG. 20 is a front view of a bulb globe with an integral separator inserted into a base of one embodiment of a light unit of the present invention.

Referring to FIGS. 19 and 20, globe 108 is inserted into base 210. As described above, base 210 does not include a first separator. Separator 118 and lead wires 116 of globe 108 protrude through one or more openings in the bottom of base 210 to form bulb 102.

Although bulb 102 is depicted as an incandescent bulb with glass globe 108 and filament 110, bulb 102 may comprise other light sources and materials. In one embodiment, bulb 102 may include an LED light source encased in an epoxy or plastic globe or lens. In such an embodiment, separator 118 integrated into globe 108 would be comprised of the same material as globe 108, typically epoxy.

Figure 21:
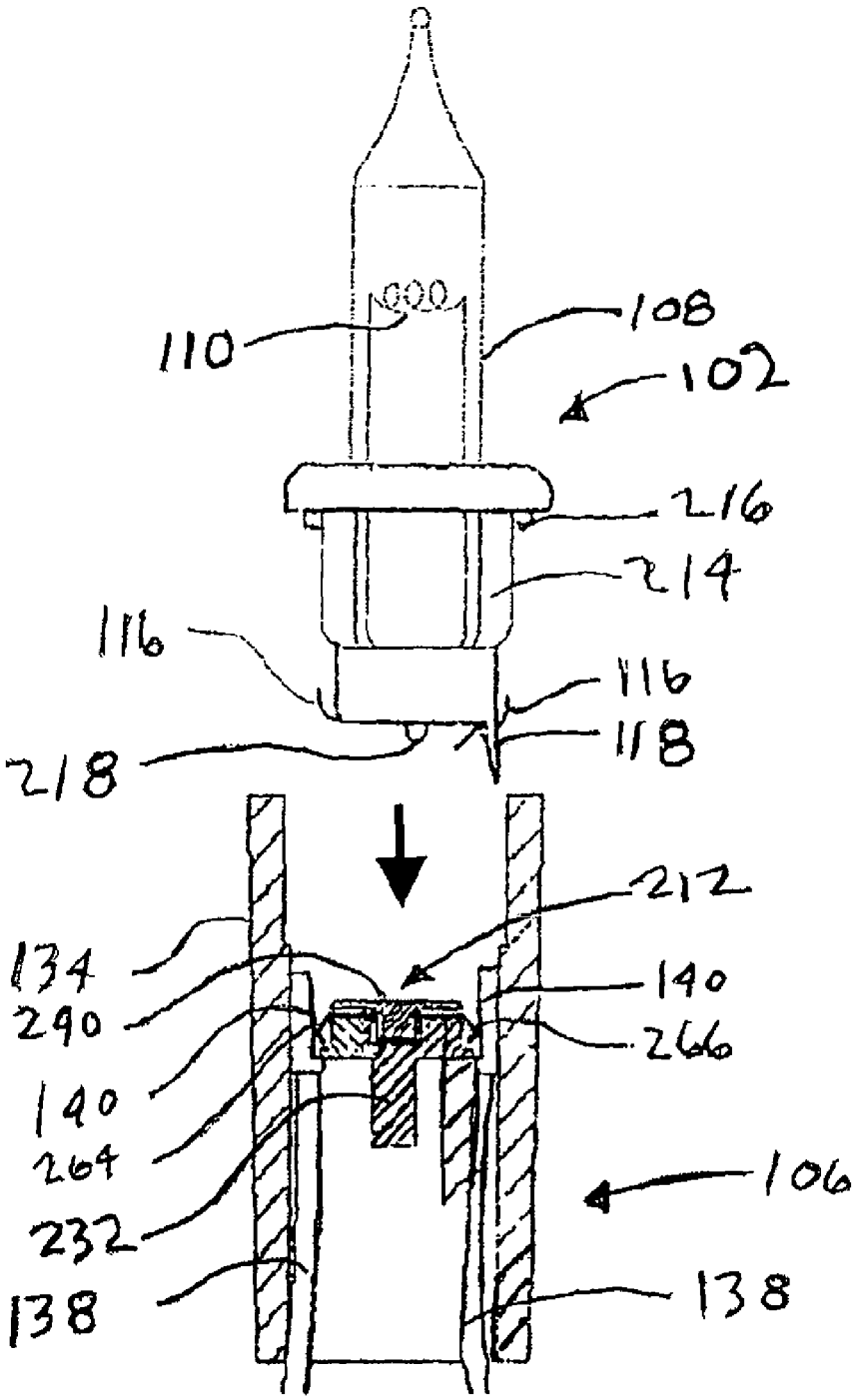
FIG. 21 is a partially exploded, front partial sectional view of one embodiment of a light unit of the present invention that includes a switch member with a single centrally located contact.

Referring to FIG. 21, in another embodiment, light unit 100 includes a bulb 102, switch 212, and socket 106. This embodiment is especially adapted to minimize the movement of the switch contacts of the switch member, thereby increasing reliability, as well as reduce the risk of electric shock due to the insertion of a foreign body into light unit 100.

Bulb 102 as described above also includes a globe 108, filament 110, and lead wires 116. In this embodiment, bulb 102 also includes a base 214 with an off-center first separator 118, optional locator projection 218 and optionally one or more key projections 216. Base 214 may be a one- or two-part base as described above, and fits over globe 108, allowing lead wires 116 to exit globe 108 and protrude through the bottom of base 214.

Figure 22:
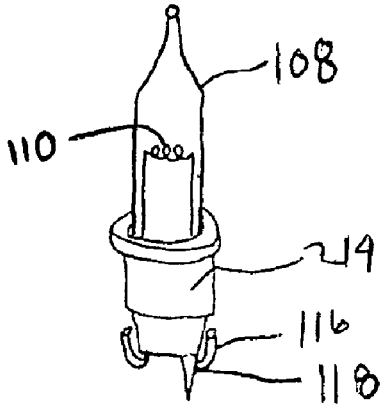
FIG. 22 is a front, perspective view of the bulb of the light unit depicted in FIG. 21.

Referring to FIGS. 22-25, base 214 can be configured in several ways to allow a portion of a lead wire 116 to be located external to base 214, with a portion of lead wire 116 in a relatively fixed position such that it can make contact with a wire terminal 140. FIG. 22 is a front perspective view of a base 214 depicting a portion of a lead wire 116 exiting through the bottom of base 214, and turned upward toward the top of base 214.

Figure 23:
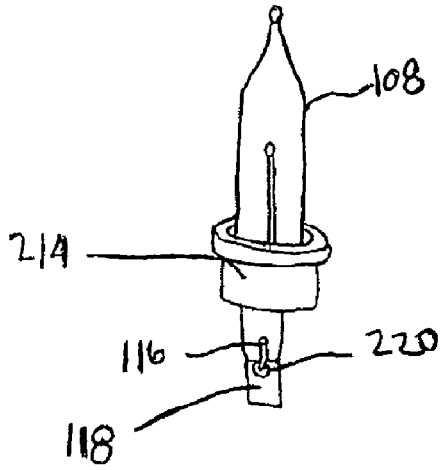
FIG. 23 is a side, perspective view of a bulb of the light unit depicted in FIG. 21.
Figure 24:
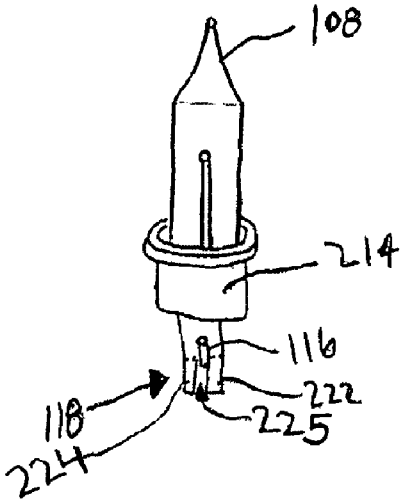
FIG. 24 is a side, perspective view of another bulb of the light unit depicted in FIG. 21.
Figure 25:
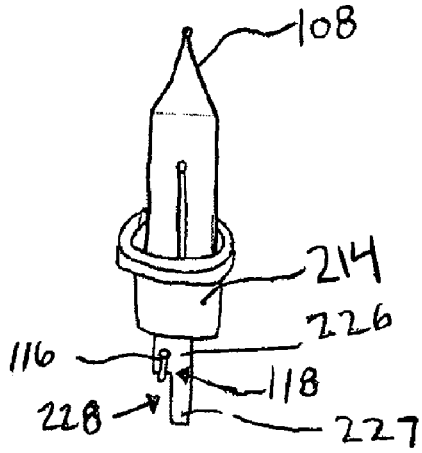
FIG. 25 is a side, perspective view of yet another bulb of the light unit depicted in FIG. 21.
Figure 26:
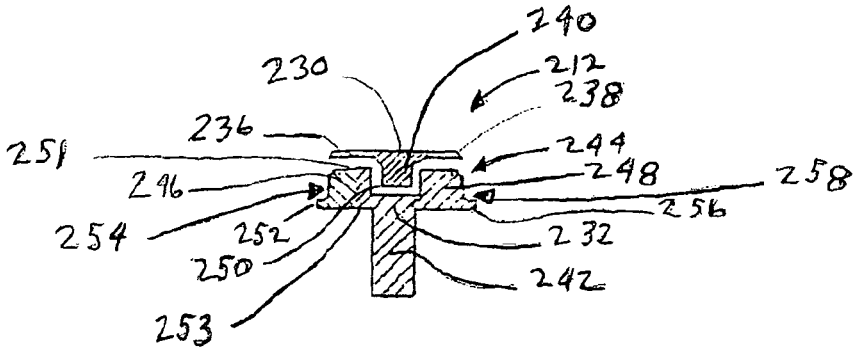
FIG. 26 is a front view of a support member and switch cap of a switch member of the light unit depicted in FIG. 21.

FIGS. 23-25 are side perspective views of bulb 102, depicting three respective embodiments of base 214 and first separator 118.

Referring to FIG. 23, first separator 118 is integral, or connected to, base 214 and may be comprised of a single rectangular tab extending downward and away from base 214. A lead wire hole 220 is located in first separator 118. A lead wire 116 exits globe 108 and is threaded through lead wire hold 220 such that it extends outwardly and upwardly from separator 118. Although a portion of lead wire 116 is allowed to move freely, the portion nearest lead wire hole 220 will not be able to be moved easily, thereby ensuring that when bulb 102 is inserted into socket 106, at least a portion of lead wire 116 will come into contact with a wire terminal 140 as further depicted in FIG. 21.

Referring to FIG. 24, in another embodiment of base 214 and first separator 118, first separator 118 is generally rectangular shaped, but in this embodiment includes a pair of extensions 222 and 224 located at an end farthest from base 214, and forming a lead wire slot 225. In this embodiment, lead wire 116 exits globe 108 and is held in place by slot 225. Although this embodiment may allow greater movement of a lead wire 116, this embodiment may also be more easily assembled during manufacture of light unit 100.

Referring to FIG. 25, in yet another embodiment of base 214 and first separator 118, first separator 118 includes single extension 227 and lead wire receiving region 228. Other similar embodiments and variations of base 214 may be considered within the scope of this invention as are alternate extensions as shown in FIGS. 17-20.

Referring to FIGS. 26-29, switch member 212 includes a switch cap 230, support member 232, and contact 234. In some embodiments, switch cap 230 may be integral to support member 232 to form a single support member 232. In the embodiment depicted, switch cap 230 includes first end portion 236, second end portion 238 and projection 240. In the depicted embodiment, support member 232 is generally T-shaped, and includes second optional separator 242 and head portion 244. Head portion 244 includes first support portion 246 and second support portion 248 forming a contact receiving area 250. Head portion 244 further includes a top surface 251, bottom surface 253, first projection 252, first swing area 254, second projection 256, and second swing area 258. Second separator 242 projects downwardly and away from head portion 244. First support portion 246 and first projection 252 form swing area 254, while second support portion 248 and second projection 256 form swing area 258.

Figure 27:
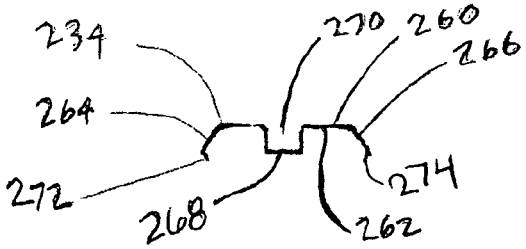
FIG. 27 is a front view of one embodiment of a contact of the light unit depicted in FIG. 21.
Figure 28:
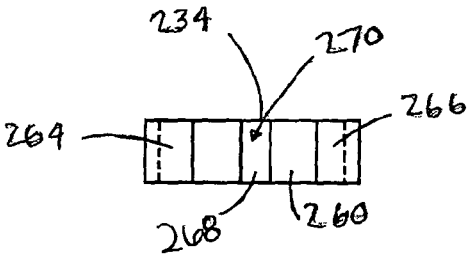
FIG. 28 is a top view of the embodiment of the contact of the light unit depicted in FIG. 27.

In one embodiment as depicted in FIGS. 27 and 28, contact 234 comprises a single conductive strip, or alternatively, a series of conductive strips joined together, forming a shape adapted to fit between support member 232 and switch cap 230. Contact 234 comprises top surface 260, bottom surface 262, first end 264, second end 266, and middle portion 268, forming channel 270. First and second ends 264 and 266 may also include respective first and second end tabs 272 and 274.

As depicted in FIGS. 26-29, when switch member 212 is assembled, contact 234 is located atop head portion 244 of support member 232 such that bottom surface 262 of contact 234 is adjacent top surface 251 of support member 232. Further, middle portion 268 of contact 234 fits into contact receiving area 250, restricting movement of contact 234 toward or away from wire terminals 140. Switch cap 230 is located atop contact 234, such that contact 234 is located between switch cap 230 and head portion 244 of support member 232. Further, projection 240 fits into channel 270 of contact 234.

In some embodiments, switch cap 230, contact 234, and support member 232 are sized so that when the three components are assembled to form switch member 212, the components stay attached via friction. In other embodiments, an adhesive, or other means, may be used to form switch member 212.

As assembled, first end 264 and second end 266 of contact 234 do not contact head portion 244 in the absence of an external force applied to ends 264 and 266. In the presence of an applied external force, such as the force applied by a separator 118, ends 264 and 266 may move downwards and towards the head portion 244, moving through swing areas 254 and 256.

Referring to FIG. 21, switch member 212 is inserted into socket 106. In the absence of bulb 102, both ends 264 and 266 of contact 234 contact their respective wire terminals 140, creating a physical connection such that when light unit 100 is powered, current may flow through a terminal 140, through contact 234, and through a second terminal 140, maintaining power to other light units 100 in a light string.

Figure 29:
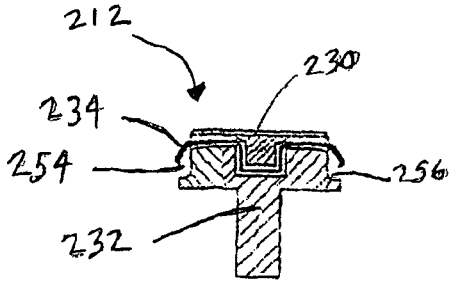
FIG. 29 is a front view of one embodiment of a switch member of the light unit depicted in FIG. 21.

Referring to FIGS. 27 and 29, an alternate embodiment may use a spring, such as a coil spring, between ends 272 and 274 in the support member 232, eliminating channel 270 in the contact 234, or individual springs in contact with ends 272 or 274 independently to provide additional longevity to the mechanism. Another alternate embodiment replaces contact 234 with a coil spring located inside support member 232.

Figure 30:
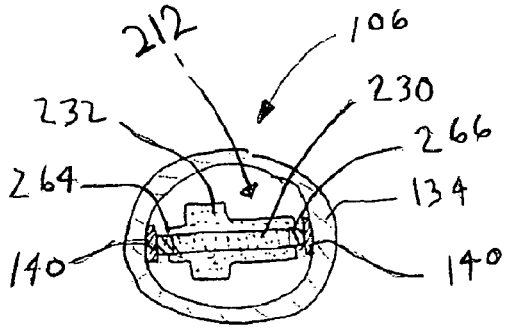
FIG. 30 is a top view of one embodiment of a switch member inserted into a socket of the light unit depicted in FIG. 21

FIG. 30 depicts a top view of socket 106 with switch member 212 inserted. This view not only illustrates the physical contact between contact 234 and terminals 140, but also illustrates some safety features of this embodiment of light unit 100. The light unit of the present invention, unlike previously known light units, minimizes the exposure of conducting surfaces within socket 106, when bulb 102 is not inserted. In this embodiment, switch cap 240 covers the majority of contact 234, minimizing the amount of contact 234 available for contact with a foreign body, such as a finger or other object, that may accidentally be inserted into socket 106. Further, because the electrical connections are made near the inside walls of socket 106, rather than in a central region, the likelihood of a foreign object coming between a terminal 140 and contact 234 is reduced. Finally, because swing areas 254 and 256 are relatively small, and the movement of contact 234 minimal, only small objects may be inserted between terminals 140 and contact 234, thereby potentially reducing the risk of electrical shock.

A further advantage of this embodiment of light unit 100 is its ability to accept bulb 102 with separator 118 located at either side of socket 106. Both sides of socket 106 and switch member 212 can act independently as a switch, with the switching side determined by the first separator location on the base of the bulb. This allows for a bilateral insertion of bulb 102 and base 214 into socket 106, yet allowing the bypass switch connection to be broken and allow bulb 102 to illuminate regardless of which direction bulb base is 214 inserted. The bilateral nature of the construction also provides manufacturing advantages such as shortened assembly time and a decrease in string failures due to bulbs being inserted the wrong way into the lamp holder. It also improves the chances of proper bulb replacement by consumers, as they can easily replace the bulb in either direction, and prevents frustration and modification of the set by consumers when they cannot get the bulb to fit, except in one orientation.

Figure 31:
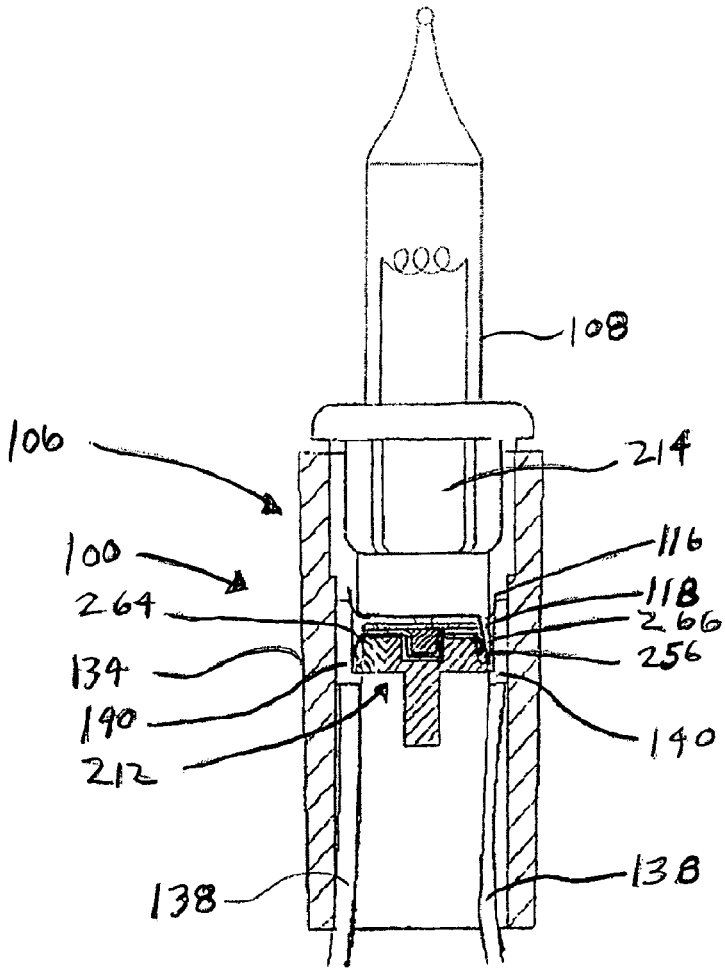
FIG. 31 is a front partial sectional view of one embodiment of the light unit of FIG. 21, depicting a bulb inserted into a socket.

Referring to FIG. 31, when bulb 102 is fully inserted into socket 106, lead wires 116 contact their respective wire terminals 140. In the embodiment depicted, separator 118 is located at a right-side of base 214 and socket 106, between a right-side terminal 140 and second end 266 of contact 234. When bulb 102 is inserted into socket 106, separator 118 forces end 266 of contact 234 downwards and away from right-side terminal 140, separating end 266 and terminal 140. Because separator 118 is made of a substantially non-conducting material, typically some kind insulating material, such as of plastic or alternatively of glass, when light unit 100 is powered, current will not substantially flow through contact 234. If bulb 102 is removed, or becomes partially removed, end 266 of contact 234 will spring towards terminal 140, creating a physical and electrical contact point, allowing current to flow through wires 138, contact 234 and terminals 140, thereby maintaining power to other connected light units 100.

Although the embodiment depicted in FIG. 31 illustrates a single separator 118 located at a right-side of socket 106, in other embodiments, separator 118 may be located at a left-side, or other region generally adjacent an inside surface of housing 134. Further, two opposing separators 118 may also be employed, each contacting a respective end 264 and 266.

Figure 32:
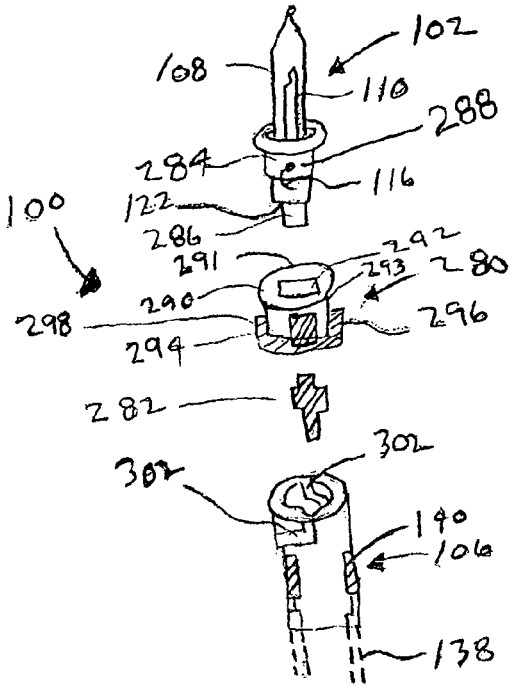
FIG. 32 is an exploded, front partial sectional view of one embodiment of a light unit of the present invention that includes a rotating switch member.

Referring to FIG. 32, another embodiment of light unit 100 incorporates a rotating action to make and break an electrical bypass switch within socket 106. In this embodiment, light unit 100 includes a bulb 102, rotating switch member 280, optional rotation pin 282, and socket 106. This embodiment provides improved reliability through a number of features that ensure that the switch contacts make and break consistently, including a locking feature to hold bulb 102 in its proper position within socket 106.

In the embodiment depicted, bulb 102 includes globe 108, filament 110, lead wires 116, and base 284. Base 284 includes bottom 122, key 286 and one or more locking protrusions 288. Similar to previously described embodiments, lead wires 116 exit globe 108, and pass through openings in base 284, becoming accessible for electrical connection. Key 286 in some embodiments may be a generally rectangular-shaped extension projecting downward and away from an upper portion of base 286, and adapted to fit into switch member 280. However, other shapes of key 286, such as triangles, ovals, trapezoids, and so on, may be employed.

Figure 33:
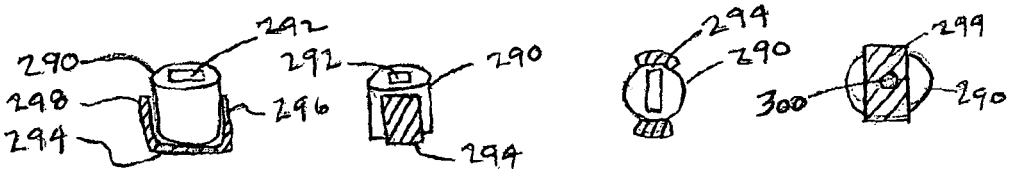
FIG. 33 is a series of front, side, top and bottom views of a rotating switch member of the embodiment of the light unit depicted in FIG. 32.

Referring to both FIGS. 32 and 33, switch member 280 in the embodiment depicted is comprised of body 290 and contact 294. Body 290 includes a key opening 292, top surface 291, and side surface 293. Body 290 is generally cylindrical and partially hollow so as to accept key 286. Typically, body 290 is comprised of a substantially non-conductive material, such as plastic. Attached to body 290 is contact 294. Contact 294 may be generally U-shaped as depicted in FIG. 32. Contact 294 extends across the bottom of body 290, partially up the outside surface of body 290 and with a first end 296 and a second end 298 located generally opposite each other, with body 290 in between. Contact 294 may also include a hole or dimple 300 adapted to contact a top portion of rotation pin 282 and facilitate rotation of switch member 280. Contact 294 may be made of a substantially conducting material such as brass, copper, or steel, with varying widths and thicknesses.

Referring again to FIG. 32, socket 106 is substantially similar to sockets 106 described above, in that socket 106 includes housing 134, wires 138, terminals 140, and so on. However, socket 106 as depicted in FIG. 32 also includes a pair of locking channels 302. Locking channels 302 are generally L-shaped and in one embodiment are molded, cut, or otherwise located at the inside surface of housing 134. Locking channels 302 are sized to receive locking protrusions 288 of base 284.

When light unit 100 is assembled, key 286 is inserted into key opening 292 of body 290 of switch member 280, such that base bottom 122 is adjacent to a top surface of barrel 290. Lead wires 116 extend outward and away from base 284 and when fully inserted into socket 106, contact terminals 140.

In one embodiment, as depicted in FIGS. 32 and 33, switch member 280 contacts a top portion of rotation pin 282, and may be supported by pin 282. A top protrusion of pin 282 may align with hole or dimple 300 in switch member 280 to facilitate rotation while fixing the relative location of pin 282 and switch member 280.

Bulb 102, switch member 280, and pin 282 are inserted into socket 106. In one embodiment, locking protrusions 298 must align with locking channels 302 in order for bulb 102 to be inserted into socket 106. Locking bulb 102 into socket 106 increases reliability by decreasing the likelihood of bulb 102 loosening up, or falling out of, socket 102. However, in other embodiments, locking protrusions 298 and locking channels 302 may not be used.

After insertion, but before rotation, ends 296 and 298 are in contact with terminals 140, creating an electrical connection, or short circuit between terminals 140. In this position, wire leads 116 are not in contact with terminals 140, and bulb 102 is not illuminated. Because contact 294 is sufficiently large, bulb 102 may be slightly rotated such that wire leads 116 are not in contact with terminals 140, but ends 296 and 298 still make contact with terminals 140. With the bulb in this bypass-on position, when light unit 100 is powered, current will flow through contact 294 and to other light units 100 in the light string.

Figure 34:
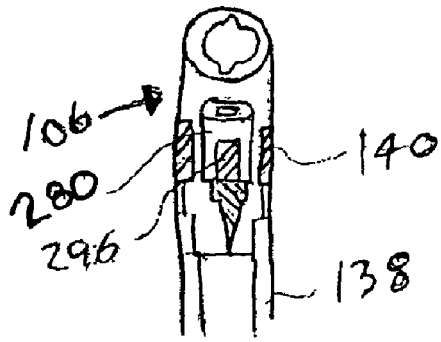
FIG. 34 is a front partial sectional view of the socket with inserted rotating switch member of the light unit depicted in FIG. 32.

After insertion, bulb 102 is rotated approximately 90 degrees to lock bulb 102 into position with socket 106. As bulb 102 is rotated, key 286 inserted into body 290 causes switch member 280 to rotate. Rotating body 290 a short distance causes ends 296 and 298 to break contact with terminals 140, leaving switch member 280 in the bypass-off position as illustrated in FIG. 34. Rotating bulb 102 and switch member 280 nearly 90 degrees causes lead wires 116 to contact their respective wire terminals 140, thereby illuminating bulb 102 when power is applied to light unit 100. The distance or degree of rotation required to move switch member 280 to the bypass-on or bypass-off position depends primarily on the size of contact 294 relative to socket 106 and terminals 140. Size may be adjusted to increase or decrease the sensitivity of the bypass on/off function.

After insertion and rotation, should bulb 102 through mishandling, vibration, or otherwise, rotate back such that lead wires 116 no longer make contact with terminals 140, switch member 280 will also move into a bypass-on position allowing electricity to flow to other light units 100.

Figure 35:
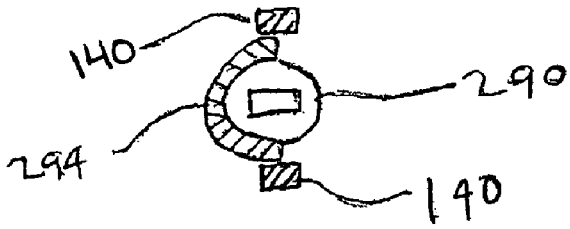
FIG. 35 is a top view of an alternate rotating switch member in the bypass-on position of one embodiment of a light unit of the present invention.
Figure 36:
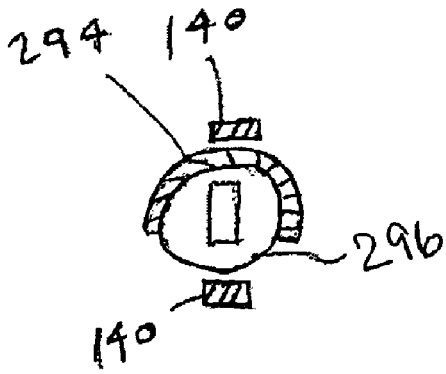
FIG. 36 is a top view of an alternate rotating switch member in the bypass-off position of one embodiment of a light unit of the present invention.

Referring to FIGS. 35 and 36, in an alternate embodiment of switch member 280, contact 294 does not extend across the bottom of body 290, but rather wraps around a portion of body 290, adjacent to outside surface 293. In the embodiment depicted, contact 294 traverses approximately one-half the circumference of body 290.

In the bypass-off position depicted in FIG. 36, contact 294 contacts only one terminal 140. In the bypass-on position depicted in FIG. 35, when body 290 is rotated approximately 90 degrees, contact 294 contacts terminals 140 at opposing ends of contact 294.

Figure 37:
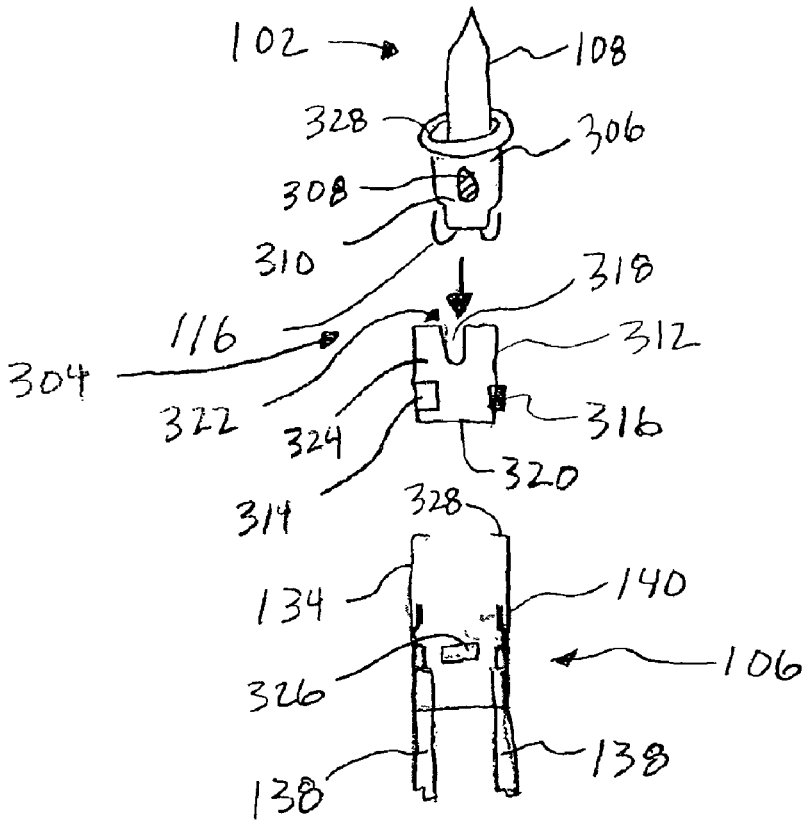
FIG. 37 is an exploded, front partial sectional view of one embodiment of a light unit of the present invention that includes an alternate rotating switch member.

Referring to FIG. 37, another embodiment of light unit 100 uses an alternative rotating switch member. In this embodiment, light unit 100 includes bulb 102, rotating switch member 304, and socket 106. Bulb 102 includes base 306, which may include key 308 located on an outside surface 310 of base 306. Key 308 may be located between and above lead wires 116.

Figure 38:
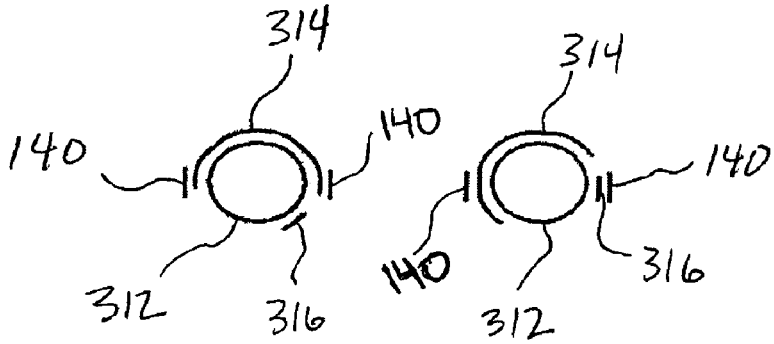
FIG. 38 is a pair of top views of an alternate rotating switch member in the bypass-on and bypass off positions of one embodiment of a light unit of the present invention.

Rotating switch member 304 includes body 312, large contact 314, small contact 316, and key slot 318. Body 312 may be cylindrical-shaped, and may have a solid bottom 320, top opening 322 and side wall 324. Large contact 314 in the embodiment depicted is a relatively thin, curvilinear, rectangular conducting contact that wraps around approximately one-half of body 312. As depicted in FIG. 38, small contact 316 is similarly constructed, except relatively short. Small contact 316 is located anywhere from 0 to 45 degrees about the circumference of body 312, from large contact 314. The distance between large contact 314 and small contact 316 affects sensitivity of switch member 304 as discussed further below, and may vary depending on desired sensitivity. Both contacts penetrate side wall 324 such that when bulb 102, including lead wires 116, are inserted into body 312, lead wires 116 may directly contact contacts 314 and 316.

Socket 106 is substantially similar to sockets 106 described in previous embodiments, but may include some additional features. In the embodiment depicted in FIG. 37, socket 106 includes a switch shelf 326 located above the bottom of housing 106. Switch shelf 326 may be supported at an inside surface of housing 134, or from a support pillar extending from shelf 326 downwards to the bottom of socket 106, or alternatively, the shelf 326 may be an insert into the socket 106. Switch shelf 326 supports switch member 304, locating it above the bottom of socket 106 and adjacent to terminals 140, and providing a surface on which to rotate.

Socket 106 may also include a snap ridge 328 which prevents switch member 304 from being easily removed once inserted into socket 106. Snap ridge 328 comprises a ring integral to the top of socket housing 134, the ring having an inner diameter slightly smaller than the inner diameter of housing 134 and the outer diameter of switch member 304. Snap ridge 328 may also have a slightly rounded, or downwardly inclining upper surface to facilitate switch member 304 being forcibly inserted into socket 106. When bulb 102 is removed from socket 106, although switch member 304 may move within socket 106, snap ridge 328 will prevent switch member 304 from easily falling out of socket 106.

Figure 39:
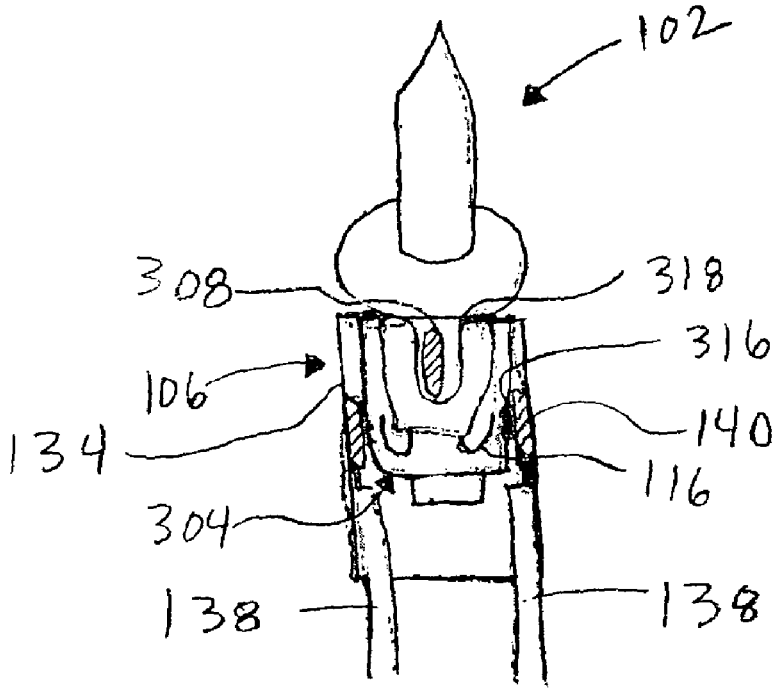
FIG. 39 is a front partial sectional view of one embodiment of a light unit of the present invention that includes an alternate rotating switch member.

Referring now to both FIGS. 37 and 39, as assembled, bulb 102 with base 306 is inserted into body 312. Key 308 is inserted into key opening 318, causing one lead wire 116 to make contact with large contact 314, and one lead wire 116 to make contact with small contact 316. Bulb 102 with switch member 304 is pushed past snap ridge 328 and into socket 106. When fully inserted, switch member 304 is adjacent to, or rests upon, switch shelf 326. In the position depicted in FIGS. 37 and 39, large contact 314 is in contact with one wire terminal 140, while small contact 316 is in contact with the other wire terminal 140. As such, lead wires 116 are in electrical contact with wire terminals 140, and when light unit 100 is powered, bulb 102 illuminates. This represents the bypass-off position.

Referring to FIG. 38, the spatial relationship between contacts 314 and 316 and their respective wire terminal 140 is depicted. In the bypass-off position as discussed above, large contact 314 is in contact with one wire terminal 140. Small contact 316 is in contact with the opposite terminal 140. When bulb 102 and switch member 304 are rotated, small contact 316 no longer is in contact with its wire terminal 140. However, large contact 314 remains in contact with its original terminal 140, and as switch member 304 is rotated further, also comes into contact with the other opposite wire terminal 140. This creates an electrical connection between the two wire terminals, and represents the bypass-on position of switch member 304.

Figure 40:
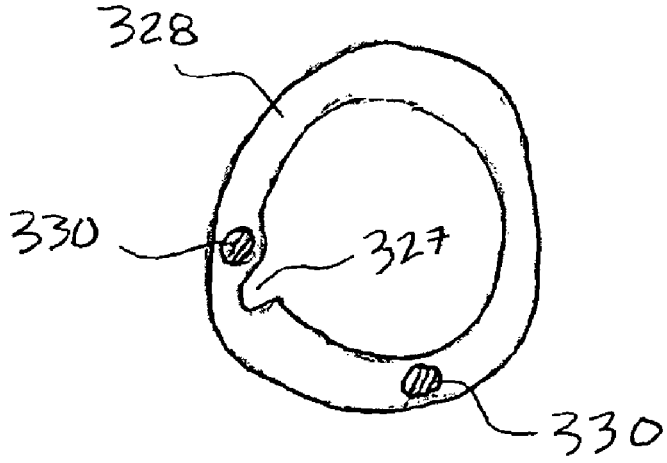
FIG. 40 is a top view of a snap ridge of one embodiment of a light unit of the present invention.

To limit the rotational distance that switch member 304 may be moved, socket 106 may provide switch member stops. In the embodiment depicted in FIG. 40, snap ridge 328 includes a key slot 327 to allow key 308 to pass through snap ridge 328 while at the same time properly aligning switch member 304 in socket 106.

Snap ridge 328 may also include a pair of small protrusions 330 located on its lower, inside surface, and positioned approximately 90 degrees apart. The small protrusions are located one on either side of the key slot of snap ridge 328. Small protrusions 330 are large enough to stop the rotation of switch member 304 key 308 of base 306 comes into contact with a protrusion 330. In this way, rotation of switch member 304 is limited to 90 degrees.

In another embodiment, rather than including protrusions 330, the thickness of snap ridge 328 is varied. More specifically, the thickness of snap ridge is thinner in a region near key slot 327, and extending 90 degrees about the circumference of snap ridge 328. Elsewhere, snap ride 328 is thicker. Switch member 304 may only be rotated such that key 308 is always adjacent and below the thin region of snap ridge 328. In other words, the two regions of snap ridge 328 that transition from thin to thick act as stops to key 308 and switch member 304, thereby limiting the rotation of switch member 304 to a 90 degree span.

A further advantage of this embodiment of light unit 100 is its ability to lock the bulb in place once rotated into position. This prevents bulb 102 from accidentally falling out because of vibration or accidental contact.

Figure 41:
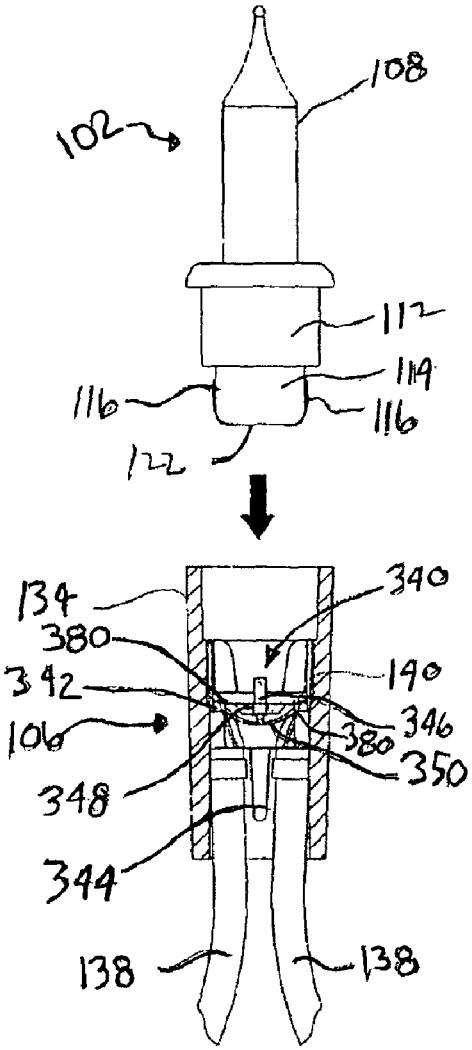
FIG. 41 is an exploded, front partial sectional view of one embodiment of a light unit of the present invention that includes a push-pin actuated switch member.
Figure 42:
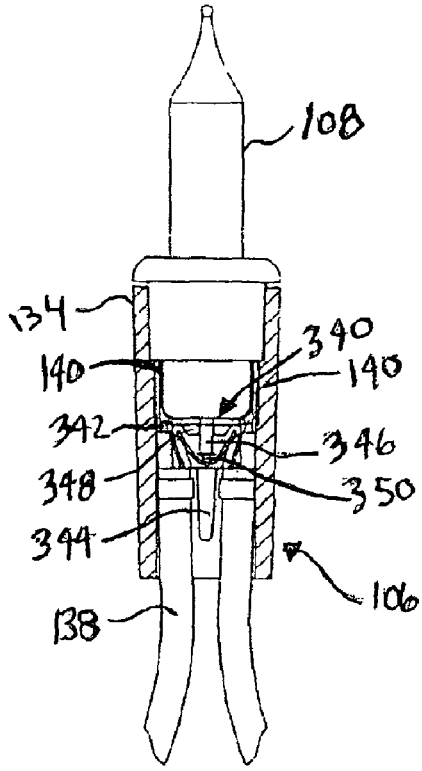
FIG. 42 is a front partial sectional view of one embodiment of a light unit of the present invention that includes a push-pin actuated switch member.

Referring now to FIGS. 41 and 42, in another embodiment light unit 100 utilizes a center push pin and contact in switch member 340. In this embodiment, light unit 100 includes a bulb 102, switch member 340, and socket 106.

Bulb 102 includes a globe 108, base 112, subsidiary base 114, lead wires 116, and base bottom 122. Specific details of bulb 102 are essentially the same as those described above with reference to FIGS. 1 to 6, with the exception that bulb 102 as depicted in FIG. 41 does not include a separator 118.

Socket 106 includes housing 134, wires 138, and wire terminals 140, similar to those described in the embodiments above.

Switch member 340 includes a cradle member 342, an optional second separator 344, push pin 346, guide plate assembly 348, and flexible contact 350.

Figure 43A:
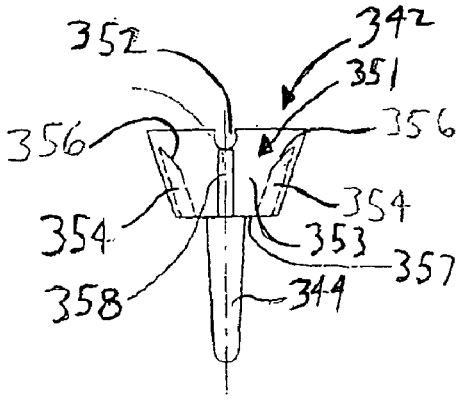
FIG. 43*a* is a front view of a cradle member of a switch member of the embodiment of the light unit depicted in FIG. 42.
Figure 43B:
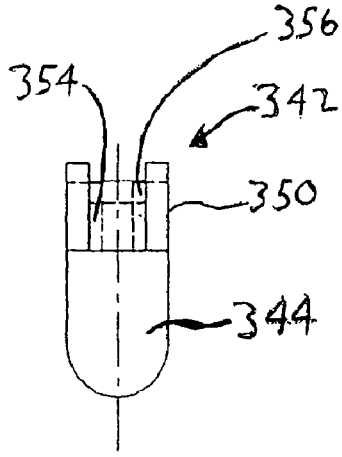
FIG. 43*b* is a side view of a cradle member of a switch member of the embodiment of the light unit depicted in FIG. 42.
Figure 43C:
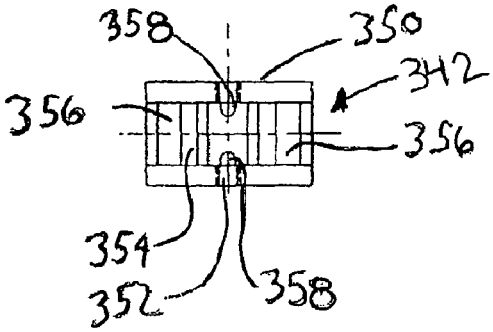
FIG. 43*c* is a top view of a cradle member of a switch member of the embodiment of the light unit depicted in FIG. 42.

Referring to FIGS. 43*a, b*, and *c*, cradle member 342 includes cradle groove 352, an optional pair of side walls 353, a pair of end walls 354 with slide surfaces 356, bottom 357, and a pair of guide posts 358. Side walls 353, end walls 354 and bottom 357 of cradle member 342 form cavity 351. End walls 354 angle outward from the center of cradle member 342. Near the upper end of each end wall 353 is a slide surface 356. Slide surface 356 as depicted forms an acute angle with an outside surface of each end wall 353. Guide posts 358 are generally cylindrical in shape and project from bottom 357 upwards through cavity 351, ending near the top of cradle member 342. Each guide post is located adjacent to an inside surface of a side wall 353 opposite one another and generally towards the center of each side wall 353.

Figure 44:
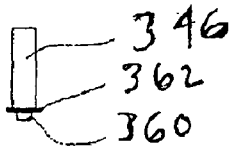
FIG. 44 is a front view of a push pin of a switch member of the embodiment of the light unit depicted in FIG. 42.

Referring to FIG. 44, push pin 346 may be of any shape, but is depicted as a cylindrical pin in this embodiment. Push pin 346 may include a push tip 360 and push ridge 362. Push pin 346 in some embodiments may have a length that is approximately the same as the depth of cavity 351, or slightly longer.

Figure 45A:
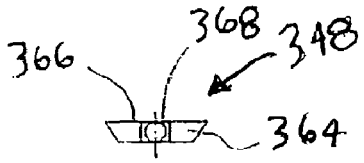
FIG. 45*a* is a front view of a guide plate assembly of a switch member of the embodiment of the light unit depicted in FIG. 42.
Figure 45B:
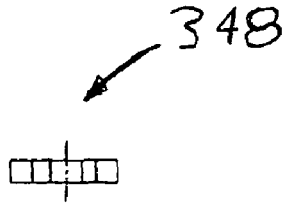
FIG. 45*b* is a side view of a guide plate assembly of a switch member of the embodiment of the light unit depicted in FIG. 42.
Figure 45C:
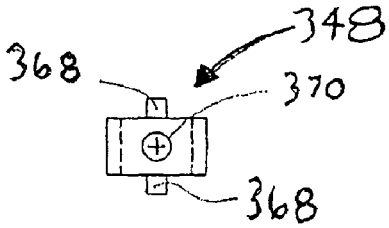
FIG. 45*c* is a top view of a guide plate assembly of a switch member of the embodiment of the light unit depicted in FIG. 42.

Referring to FIGS. 45*a* to 45*c*, guide plate assembly 348 includes guide plate 364, plate top surface 366, posts 368, and center hole 370. Posts 368 are located one on each side of plate 364 and are generally cylindrical. The ends of plate 364 may be beveled, and center hole 370 passes through the thickness of plate 364.

Figure 46A:
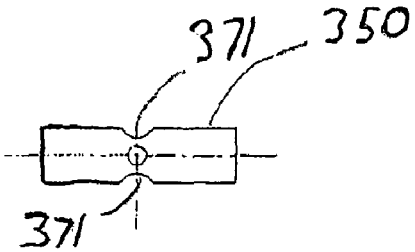
FIG. 46*a* is a front view of a contact of a switch member of the embodiment of the light unit depicted in FIG. 42.
Figure 46B:
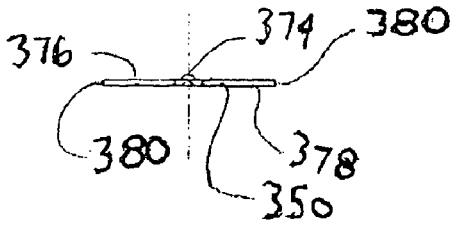
FIG. 46*b* is a side view of a contact of a switch member of the embodiment of the light unit depicted in FIG. 42.

Referring to FIGS. 46*a* and 46*b*, contact 350 may be rectangular in shape, thin, and flexible. Contact 350 is comprised of a substantially conductive material such as brass, copper, steel, or other materials described above and used in other contacts and terminals of other described embodiments. Contact 350 includes a pair of guide post cutouts 371, raised dimple 374 or other locator device, top surface 376, and bottom surface 378.

Figure 47A:
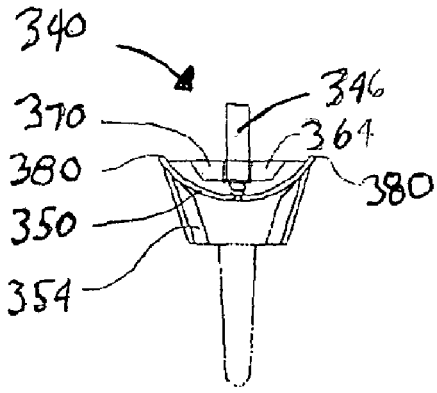
FIG. 47*a* is a front view of a switch member of the embodiment of the light unit depicted in FIG. 42 in the bypass-on position.

FIG. 47*a* depicts one embodiment of a fully assembled switch member 340. As depicted, contact 350 is fit into cradle member 342, contacting end walls 354 at slide surfaces 356. Push pin 346 is inserted through guide plate center hole 370. The upward travel of push pin 346 is limited by push ridge 362. Posts 368 of guide plate 364 snap fit into grooves 352 of cradle member 342, thereby locating guide assembly 348 onto cradle member 342. As assembled, and with push pin 346 in its most upward position, push pin 346 contacts contact 350 at dimple 374 with push tip 360, forcing the center of contact 350 downward. In such a position, contact 350 is slightly flexed, with each end of contact 350 projecting slightly beyond the side walls 354 and end walls 353. Contact 350 is further held into position via contact cutouts 371 sliding along guide posts 358.

Figure 47B:
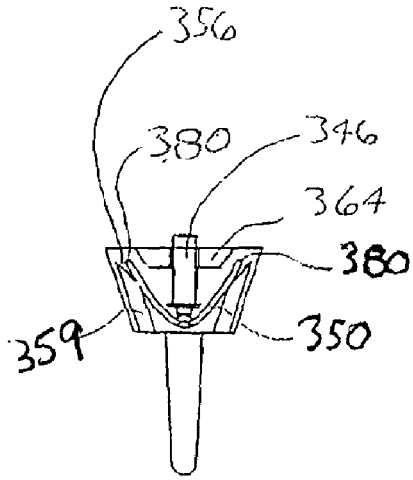
FIG. 47*b* is a front view of a switch member of the embodiment of the light unit depicted in FIG. 42 in the bypass-off position.

Referring to FIG. 47*b*, when a force is applied to push pin 346 it travels downward through guide plate center hole 370, forcing contact 350 to flex further. A center portion of bottom surface 378 of contact 350 may contact, or nearly contact cradle bottom 357 as contact 350 is forced downward. As the center of contact 350 is forced downward by push pin 346, bottom surface 378 slides along slide surfaces 356 of end walls 354, and contact ends 380 move generally downward and into cavity 351.

Referring again to FIG. 41, when bulb 102 is not inserted into socket 106, no downward force is applied to push pin 346, and ends 380 of contact 350 contact terminals 140. In this bypass-on position, with power applied, current flows from one wire terminal 140 through contact 350 and into the other wire terminal 140. This allows current to flow to other light units 100 when bulb 102 is removed from, or loose in, socket 106.

Another embodiment to provide long term flexing durability to the switch member adds one or more springs, which may be of a coil type, between the bottom of contact 350 and surface 357 to force contact 350 back into its bypass position.

Another embodiment would be to integrate push pin 346 into bottom 122 of subsidiary base 114.

Referring again to FIG. 42, when bulb 102 is inserted into socket 106, a downward force is applied by bulb 102 to push pin 346, causing contact 350 to flex, and ends 380 to withdraw into cradle member 342 cavity 351. This breaks the contact between ends 380 and terminals 140, thereby interrupting the flow of current. Since wire leads 116 make contact with terminals 140 when bulb 102 is inserted into socket 106, when power is applied, bulb 102 is illuminated.

The embodiments as described in FIGS. 41-47 provides a more reliable and durable way of ensuring that current continues to flow to light units 100 in a light string, even when one or more bulbs 102 become loose or are removed. Further, this push pin embodiment of light unit 100 may be more sensitive to loose bulbs than previously known light units. This embodiment also provides additional safety features in that it minimizes the exposure of conducting surfaces within socket 106, when bulb 102 is not inserted. In this embodiment, guide plate 364 covers the majority of contact 350, minimizing the amount of contact 350 accessible to contact by a foreign body, such as a finger or other object, that may accidentally be inserted into socket 106. Further, because the electrical connections are made near the inside walls of socket 106, rather than in a central region, the likelihood of a foreign object coming between a terminal 140 and contact 350 is reduced, potentially reducing the risk of electrical shock.

Figure 50:
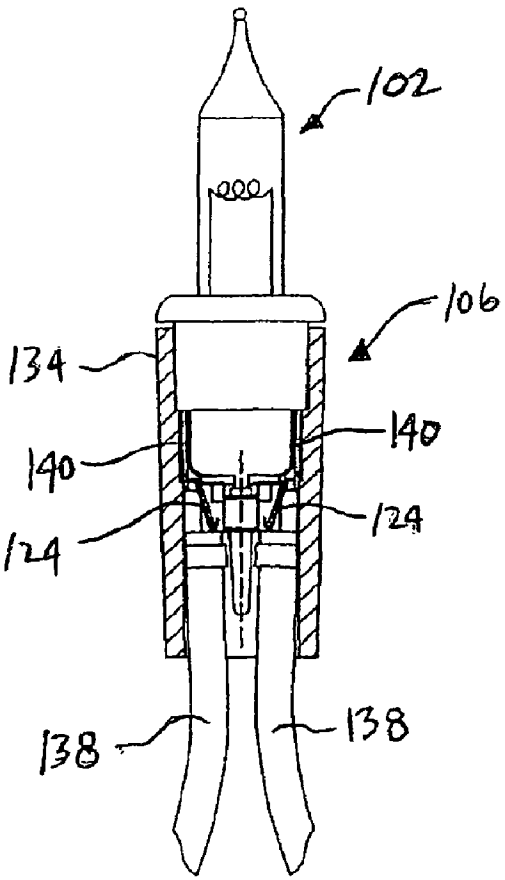
FIG. 50 is a front view of a light unit with a center contact switch member of one embodiment of the present invention.
Figure 49:
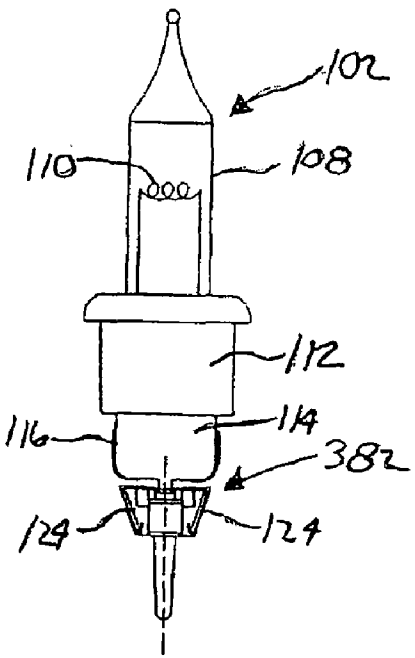
FIG. 49 is a front view of a bulb inserted into a center contact switch member of one embodiment of a light unit of the present invention.
Figure 48:
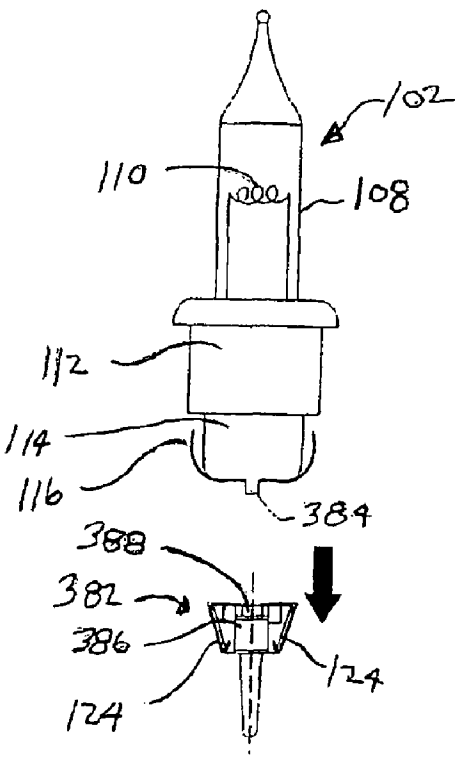
FIG. 48 is a front exploded view of a bulb and center contact switch member of one embodiment of a light unit of the present invention.
Figure 51:
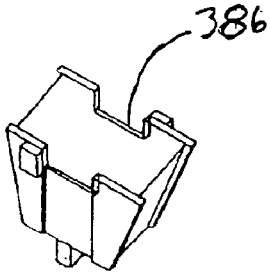
FIG. 51 is a front perspective view of a support member of a switch member of the light unit depicted in FIG. 50.

Referring now to FIGS. 48-50, in another embodiment, light unit 100 employs an alternative switch member that utilizes a centrally-located contact. In this embodiment, light unit 100 includes a bulb 102, switch member 382, and socket 106.

Bulb 102 includes a globe 108, filament 110, base 112, subsidiary base 114 with integral push pin 384, and lead wires 116.

Socket 106 is substantially the same as socket 106 as described above with respect to FIGS. 1-6.

Switch member 382 is very similar to switch member 104, but includes differences in the spring terminals and method of actuation. More specifically, and referring to FIGS. 51-54, switch member 382 includes support member 386, center contact 388, and spring terminals 124. Spring terminals 124 mount to support member 386 in a manner described above with reference to FIGS. 1-6 and support member 104. When mounted, spring terminals 124 are not in contact with each other, and a gap exists between the two as depicted in FIG. 53.

Figure 52:
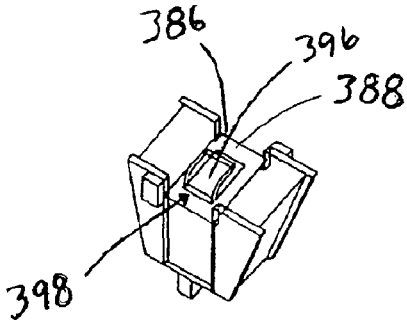
FIG. 52 is a front perspective view of a support member with a center contact of the light unit depicted in FIG. 50.
Figure 53:
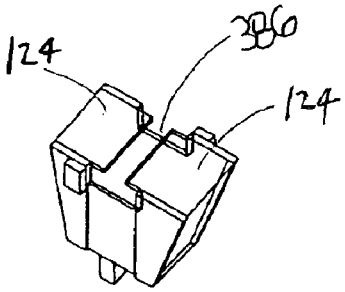
FIG. 53 is a front perspective view of a support member with spring terminals of the light unit depicted in FIG. 50.
Figure 54:
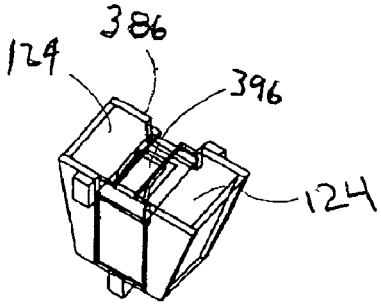
FIG. 54 is a front perspective view of a support member with center contact and spring terminals of the light unit depicted in FIG. 50.
Figure 55:
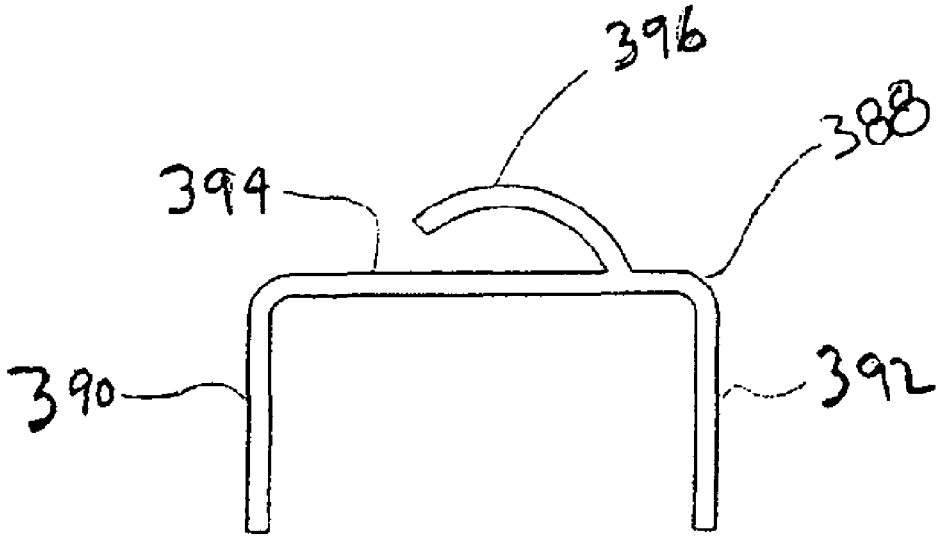
FIG. 55 is a side view of a contact of a switch member of the light unit depicted in FIG. 50.

Referring to FIGS. 52 and 55, center contact 388 may be formed by first placing two approximately 90 degree bends in a substantially rectangular, flat piece of conductive material, for example, brass, copper or steel. Bending the contact forms a first leg 390, second leg 392, and top portion 394. Center contact 388 also includes a center tab 396. Center tab 396 as depicted is attached to top portion 394 at only one end, and rises above a cutout in top portion 394. As such, when a downward force is applied to center tab 396 if flexes downward toward top portion 394. When the force is removed, center tab 396 springs back to its original position as depicted.

Center contact 388 is located on support member 386 in recess 398, with center tab 396 springing upward to contact the ends of spring terminals 124.

Referring to FIG. 49, when bulb 102 is pushed into switch member 382, push pin 384 contacts center tab 396, forcing it downward and away from spring terminals 124. In this position, with center tab 396 pushed downward, spring contacts 124 are no longer in electrical contact with each other, and switch member 382 is in the bypass off position.

Referring to FIG. 50, when bulb 102 and switch member 382 are inserted into socket 106, spring terminals 124 contact wire terminals 140. At the same time, push pin 384 is holding center tab 396 downward and away from spring terminals 124. When power is applied to light unit 100, current flows through wire terminals 140 into wire leads 116, illuminating bulb 102. Should bulb 102 become loose or removed, center tab 396 would spring upward, making contact with spring terminals 124, which in turn already contact wire terminals 140, and current would flow through terminals 124, center tab 396, and to other light units 100 in the light string.

An alternate embodiment may use a spring and flat contact in place of contact 388, wherein the spring and flat contact are entrapped below contacts 124; or may use a supplemental spring below contact 396 to provide additional longevity to the mechanism.

Any of the embodiments described herein may optionally use a supplemental fuse, or a current limiting fuse-bulb (which may be provided without a shunting device), or other current limiting circuit, to prevent excess current, and in effect excess power, dissipation, across the remaining bulbs as a level of safety, thereby preventing possible overheating of the remaining bulbs. A typical fuse bulb may be designed to open when about twenty bulbs out of fifty (or forty out of one-hundred) are burned out or removed from the set. This prevents the other bulbs from getting too hot. This bulb may be in a lamp holder that is not replaceable. This may be helpful in sets where too many bulbs are removed or loose, and in sets provided with a shunting device in each bulb, or inside the adapter across the bulb leads. Similar design characteristics would apply to supplemental fuses, or other current-limiting circuits.

Also, the above-described bases may be assembled on, or molded on, when the bulb and bulb assembly are removable. Also the bulbs may have an integral first separator and/or be provided without a base.

Also, the embodiments described herein may operate on a variety of power sources including a direct plug to utility power (120V, 208V, 220V, 240V, 280V, etc) or from a step-down power supply (such as a Class 2 power supply). The power source can be AC, DC, AC-converted-to-DC, or DC-converted-to-AC, both filtered or unfiltered DC inclusive.

The various embodiments may be part of any series connected lighting device where failure of the bulb or its connection will turn off some or all of the bulbs, and can be used in series or series-parallel connected lighting circuits. This includes mini lighting strings used for Christmas and other holiday decorative lighting, and other general lighting applications that use series connected lamps, LEDs, or other lighting elements, and utilized in such other products as a desk lamp, or under-counter light where the sources are replaceable. Types of sets may include incandescent, LED or other replaceable bulb systems.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A light unit for use in a light string, comprising:

a bulb having a light source with lead wires and a separator;

a switch member a pair of spring terminals; and a socket having two or more conductive terminals and adapted to receive the bulb and the switch member, wherein the switch member is adapted to cause the pair of spring terminals to contact one another to form an electrical short circuit across the pair of conductive terminals and the light source when the bulb is completely or partially removed from the socket, and wherein the lead wires form an electrical connection across the conductive terminals, and the separator breaks contact between the pair of spring terminals when the bulb is seated in the socket and wherein the bulb and socket have a longitudinal center axis defining generally a center line between right and left portions of each, and wherein said separator is positioned on either side of the center line, and wherein said spring terminals each extend from inside the socket from opposite sides thereof and when the bulb is not present, contacting each other at their distal ends generally midway between in the socket; said separator being positioned to engage only one of said conductive terminals when said bulb is placed in the socket.

2. A light unit for use in a light string, comprising:

a bulb having a light source and lead wires;

a rotating switch member including a support member and at least one conductor affixed to the support member; and a socket having two or more conducting terminals and adapted to receive the bulb and the switch member, wherein the rotating switch member is adapted to rotate when the bulb is completely or partially removed from the socket, thereby causing the at least one conductor to form an electrical short circuit across the pair of conductive terminals.

3. A method of maintaining electrical continuity throughout a light string, comprising:

providing a light string that includes a plurality of series-connected light units, wherein each light unit includes a bulb, socket, and rotating switch member;

providing a set of instruction steps for using the light string, including the steps of:

inserting the bulb into the socket; and rotating the bulb in the socket.

4. The method of claim 3 further including the step of keying the insertion of the bulb to prevent incorrect insertion.

5. The method of claim 3 further including the step of interrupting a shunt across the socket by interposing at least a portion of the bulb between resilient contacts in the socket.

6. A method of maintaining electrical continuity throughout a light string, having a light string that includes a plurality of series-connected light units, wherein each light unit includes a bulb, socket, and a switch member located in the socket having left and right resilient contacts , the steps comprising, locating a protrusion on the bottom of the bulb offset toward on side thereof, configuring the switch member to be in an closed circuit before a bulb is inserted into the socket and in an open circuit condition when said offset protrusion enters said socket and engaging only one of said resilient contacts.

7. A light unit for use in a light string, comprising:

a socket;

a bulb unit having a peripheral side wall and an elongated lower separator protrusion offset toward said periphery and a light source with lead wires located along the sides thereof of and a switch member having a pair of spring terminals; and having two or more conductive terminals having distal ends which contact each other at a point offset toward said periphery when a bulb unit is not present in the socket and adapted to receive the bulb unit and its lead wires wherein the switch member includes a first terminal spanning more than half the distance between the sidewalls and a second terminal spanning at least the remaining space therebetween, so that, in their relaxed state, the terminals touch, to form an electrical short circuit across the pair of conductive terminals when the bulb unit is at least-partially removed from the socket, and wherein at least one of said terminals is configured to flex in response to contact with said protrusion on the bulb unit, thereby breaking the contact between the terminals.

8. The light unit of claim 7 wherein the socket and bulb unit are keyed to limit insertion of the bulb to a keyed orientation.

9. The light unit of claim 8 wherein at least one of said spring terminals includes a protrusion extending upwardly toward a bulb receiving end of the socket to limit the intrusion of the bulb unit into the socket.

10. The light unit of claim 8 wherein said contact protrusion is rigid.

11. The light unit of claim 7 wherein said at least one spring contact includes a substantial rigid upright portion and a resilient downwardly sloping portion extending therefrom, said downwardly sloping portion having a distal end resiliently contacting the other spring contact when the bulb unit is not present.

12. A light unit for use in a light string, comprising: a socket; a bulb having a peripheral side wall and an elongated lower separator protrusion offset toward said periphery and a light source with lead wires located along the sides of a lower portion and a separator separately insertable body interposed between the bulb and socket and separate and removable from the socket, said separator including a switch member in said body having a pair of spring terminals; and having two or more conductive terminals with lower terminal ends and adapted to receive the bulb and said lead wires on said bulb, wherein the switch member has a pair of peripheral sidewalls defining a space therebetween, and a first terminal spanning more than half the distance between the sidewalls and a second terminal spanning at least the remaining space therebetween, so that, in their relaxed state, the terminals touch, and adapted to cause the pair of spring terminals to contact one another to form an electrical short circuit across the pair of conductive terminals when the bulb is at least partially removed from the socket, and wherein at least one of said terminals is configured to flex in response to contact with said protrusion on the bulb, thereby breaking the contact between the terminals.

* * * * *